US005451493A

United States Patent [19]

Merkel et al.

[11] Patent Number: 5,451,493

[45] Date of Patent: Sep. 19, 1995

[54] PHOTOGRAPHIC ELEMENT CONTAINING A CERTAIN SULFONATED ACYLACETANILIDE COUPLER IN COMBINATION WITH A DEVELOPMENT INHIBITOR RELEASING COUPLER

[75] Inventors: Paul B. Merkel; Jerrold N. Poslusny; James P. Merrill, all of Rochester, N.Y.; Bernard A. Clark, Maidenhead, United Kingdom; Paul L. R. Stanley, Harrow, United Kingdom; Hugh M. Williamson, Hanwell, United Kingdom

[73] Assignee: Eastman Kodak Company, Rochester, N.Y.

[21] Appl. No.: 214,733

[22] Filed: Mar. 17, 1994

[51] Int. Cl.[6] ..... G03C 1/46

[52] U.S. Cl. ..... 430/505; 430/544; 430/557; 430/957; 430/359

[58] Field of Search ..... 430/505, 557, 544, 957, 430/359

[56] References Cited

U.S. PATENT DOCUMENTS

| | | | |
|---|---|---|---|
| 3,973,968 | 8/1976 | Fujiwhara et al. | 96/56.5 |
| 4,022,620 | 5/1977 | Okumura et al. | 96/56.5 |
| 4,026,709 | 5/1977 | Piller et al. | 96/100 |
| 4,980,267 | 12/1990 | Taber | 430/544 |
| 5,066,574 | 11/1991 | Kubota et al. | 430/557 |

FOREIGN PATENT DOCUMENTS

| | | |
|---|---|---|
| 1039921 | 9/1978 | Canada . |
| 447969 | 9/1991 | European Pat. Off. . |
| 91/08515 | 6/1991 | WIPO . |

*Primary Examiner*—Charles L. Bowers, Jr.
*Assistant Examiner*—Geraldine Letscher
*Attorney, Agent, or Firm*—Arthur E. Kluegel

[57] ABSTRACT

The present invention provides a photographic element comprising a support bearing a blue-light sensitive silver halide emulsion layer containing an acylacetanilide yellow image dye-forming coupler having formula I or II:

I

II wherein:

$R_a$ is a substituted or unsubstituted alkyl groups, alkoxy group or aryloxy group;

$R_b$ is a substituted or unsubstituted alkyl or aryl group;

$R_c$ is hydrogen or a substituted or unsubstituted alkyl group;

$R_1$ is a substituent;

n is an integer from 0 to 2;

$R_2$ is selected from the group consisting of halogen, trifluoromethyl, and substituted or unsubstituted alkoxy and aryloxy;

$R_3$ is substituted or unsubstituted alkyl;

$R_4$ is hydrogen, halogen, alkoxy carbonyl (—$CO_2R$), carbamoyl (—CONRR′), carbonamido (—NRCOR′), sulfonamido (—$NRSO_2R'$) or trifluoromethyl; and X is hydrogen or a coupling-off group;

and wherein the blue-light sensitive silver halide emulsion layer has associated therewith a development inhibitor releasing coupler. The invention also provides a method of forming an image in such an element.

26 Claims, No Drawings

PHOTOGRAPHIC ELEMENT CONTAINING A CERTAIN SULFONATED ACYLACETANILIDE COUPLER IN COMBINATION WITH A DEVELOPMENT INHIBITOR RELEASING COUPLER

FIELD OF THE INVENTION

This invention relates to a photographic light-sensitive silver halide material comprising a certain sulfonate-substituted acylacetanilide yellow dye-forming coupler and having associated therewith a development inhibitor releasing (DIR) coupler. The invention also relates to a method of forming an image in such a photographic element.

BACKGROUND OF THE INVENTION

In a silver halide color photographic material a color image is formed when the element is exposed to light and then subjected to color development. The color development results in imagewise reduction of silver halide and production of oxidized primary amine developer. The oxidized primary amine developing agent subsequently reacts with one or more incorporated dye-forming couplers to form dye in an imagewise fashion.

Many photographic materials, especially color negative photographic materials, contain not only imaging couplers that serve merely as sources of imaging dyes but also image modifying couplers that after coupling with oxidized developer release a photographically useful group (PUG). Image modifying couplers that release an inhibitor group are referred to as DIR (Development Inhibitor Releasing) couplers. If the inhibitor is linked to the coupler via an intermediate timing group that may or may not serve to delay inhibitor release, it is sometimes referred to as a DIAR (Development Inhibitor Anchimeric Releasing) coupler. The term DIR couplers will be used herein to encompass both DIR and DIAR couplers.

DIR couplers perform one or more useful functions including control of contrast or gamma, sharpness enhancement, granularity reduction and color correction via interlayer interimage effects. The latter function is particularly important in modern color photographic materials. For example, DIR couplers are widely used in the blue-sensitive, yellow dye-forming layers of color negative films, not only for improved sharpness (or acutance) but also to reduce development and dye formation in other layers, especially adjacent green-sensitive, magenta dye-forming layers. This type of interlayer interimage effect can help correct for unwanted absorptions of the yellow dyes in areas of the negative that contain magenta dyes. It also allows a film to be constructed with higher color contrast while maintaining proper neutral contrast. To date, combinations of yellow image dye-forming couplers and DIR couplers have not provided satisfactory interlayer interimage effects.

There are many references to yellow dye-forming couplers in the art. Among them are U.S. Pat. Nos. 3,973,968 of Fujihara et al, 4,022,620 of Okumura et al and 5,066,574 of Kubota et al, which disclose the synthesis and use of yellow dye-forming couplers with hydantoin derivatives as coupling-off groups and Canadian Patent 1,039,291 which discloses yellow dye-forming couplers with oxazolidine-2,4-dione coupling-off groups.

U.S. Pat. No. 5,066,574 of Kubota et al discloses acylacetanilide yellow-dye forming couplers with sulfonate substituents, among many other substituents. International Patent WO 91/08515 of Leyshon et al discloses a sulfonate substituted pivaloylacetanilide coupler (coupler 6), among other couplers, in combination with high-chloride silver halide emulsions and bisphenol compounds. U.S. Pat. No. 4,026,709 of Piller et al discloses specific acylacetanilide yellow dye-forming couplers with sulfonate substituents, among other substituents. European Patent Application 447,969 of Shimura et al discloses a cyclic acylacetanilide yellow dye-forming coupler with a sulfonate substituent. None of these patent publications disclose the conjoint use of a sulfonate substituted acylacetanilide yellow dye-forming imaging coupler and a DIR coupler nor do any of them disclose the unexpected advantages associated with such conjoint usage.

It is a problem to be solved to provide a photographic element in which a blue-light sensitive silver halide emulsion layer has components associated with the layer that permit superior interimage effects.

SUMMARY OF THE INVENTION

The present invention provides a photographic element comprising a support bearing a blue-light sensitive silver halide emulsion layer containing an acylacetanilide yellow image dye-forming coupler having formula I or II:

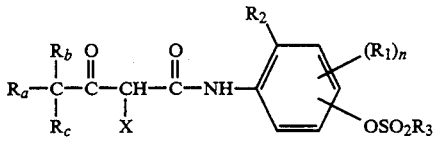

I

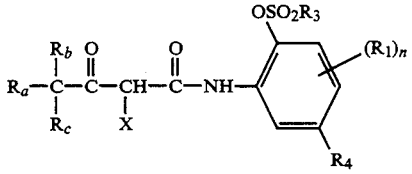

II wherein:

$R_a$ is a substituted or unsubstituted alkyl, alkoxy group or aryloxy group;

$R_b$ is a substituted or unsubstituted alkyl or aryl group;

$R_c$ is hydrogen or a substituted or unsubstituted alkyl group;

$R_1$ is a substituent;

n is an integer from 0 to 2;

$R_2$ is selected from the group consisting of halogen, trifluoromethyl, and substituted or unsubstituted alkoxy and aryloxy;

$R_3$ is substituted or unsubstituted alkyl;

$R_4$ is hydrogen, halogen, alkoxy carbonyl (—$CO_2R$), carbamoyl (—CONRR'), carbonamido (—NRCOR'), sulfonamido (—$NRSO_2R'$) or trifluoromethyl;

X is hydrogen or a coupling-off group;

and wherein the blue-light sensitive silver halide emulsion layer has associated therewith a development inhibitor releasing coupler. The invention also provides a method of forming an image in such an element.

The element of the invention exhibits superior interimage effects such as color rendition and color saturation compared to photographic elements heretofore available.

DETAILED DESCRIPTION OF THE INVENTION

The photographic element of the invention comprises a blue-light sensitive silver halide emulsion layer containing an acylacetanilide yellow image dye-forming coupler having formula I or II:

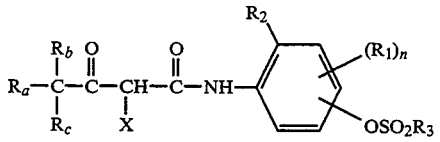

I

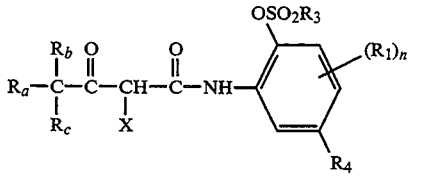

II wherein:

$R_a$ is a substituted or unsubstituted alkyl group, such as a methyl, ethyl, propyl, butyl, pentyl, hexyl, octyl, dodecyl, hexadecyl group, or an alkoxy group such as methoxy or an aryloxy group such as phenoxy, where the group may suitably contain up to 42 carbon atoms. When $R_a$ is a substituted group, suitable substituents may include, for example, alkoxy, phenoxy and phenyl groups.

$R_b$ is a substituted or unsubstituted alkyl or aryl group, suitably containing up to 42 carbon atoms, such as a methyl, ethyl, propyl, butyl, pentyl, hexyl, octyl, dodecyl, hexadecyl, or phenyl group. It is intended that formulas I and II as shown encompass also the situation where $R_a$ and $R_b$ are joined to form a ring of six or more members and the ring members satisfy the requirements for both $R_a$ and $R_b$. They may be combined for example, as a cyclohexyl group which may optionally be substituted.

$R_c$ is hydrogen or a substituted or unsubstituted alkyl group as defined for $R_a$;

$R_1$ is a substituent as defined hereafter;

n is an integer from 0 to 2;

$R_2$ is halogen, such as chlorine or fluorine, trifluoromethyl, or a substituted or unsubstituted alkoxy or aryloxy group, such as methoxy, ethoxy, tetradecyloxy, and phenoxy;

$R_3$ is substituted or unsubstituted alkyl such as the alkyl groups suitable for $R_a$;

$R_4$ is hydrogen, halogen, alkoxy carbonyl (—$CO_2R$), carbamoyl (—CONRR′), carbonamido (—NRCOR′), sulfonamido (—$NRSO_2R'$) or trifluoromethyl where R and R′ are substituted or unsubstituted alkyl groups;

X is hydrogen or a coupling-off group examples of which include, chlorine, an aryloxy group, an alkoxy group, a ballasted arylthio or alkylthio group, a carbamate group, an acyloxy group, a carbonamido group, a sulfonamido group, or a nitrogen-containing heterocyclic group, such as pyrazolyl, imidazolyl, succinimido, hydantoinyl or oxazolidine-2,4-dionyl group.

References to groups, such as alkyl, aryl, alkoxy and alkoxycarbonyl groups, are intended to include both unsubstituted and substituted groups. References to aliphatic groups, such as alkyl or alkoxy, include unbranched, branched and cyclic groups.

As used herein, the term substituent, unless otherwise specifically stated, has a broad definition. The substituent may be, for example, halogen, such as chlorine, bromine or fluorine; nitro; hydroxyl; cyano; and —$CO_2H$; and groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)-butyramido, alpha-(3-pentadecylphenoxy)hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N′-ethylureido, N-phenylureido, N,N-diphenylureido, N-phenyl-N-p-toluylureido, N-(m-hexadecylphenyl)ureido, N,N-(2,5-di-t-pentylphenyl)-N′-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)-propyl]sulfamoyl, N-[4-(2,4-di-t-pentylphenoxy)butyl]-sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-pentylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl , 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; azo, such as phenylazo and naphthylazo; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

The particular substituents used may be selected to attain the desired photographic properties for a specific application and can include, for example, hydrophobic groups, solubilizing groups, blocking groups, etc. Generally, the above groups and substituents thereof may typically include those having 1 to 30 carbon atoms and usually less than 24 carbon atoms, but greater numbers are possible depending on the particular substituents selected. Moreover, as indicated, the substituents may themselves be suitably substituted with any of the above groups.

In the most preferred embodiment, each of $R_a$, $R_b$, and $R_c$ is alkyl and all may conveniently be methyl.

To minimize water solubility and coupler wandering the total number of carbon atoms contained in $R_a$, $R_b$, $R_c$, $R_1$, $R_2$, $R_3$, $R_4$, and X taken together (it being understood that for formula I there is no $R_4$ and for formula II there is no $R_2$) should be at least 12 and preferably from about 14 to 45 . To minimize dye wandering the total number of carbon atoms in $R_a$, $R_b$, $R_c$, $R_1$, $R_2$, $R_3$, and $R_4$ taken together should be at least 9.

The coupling-off group is suitably an aryloxy or heterocyclic group. It is contemplated that the coupling-off group be selected with the imaging aspects of the coupler and subsequently formed dye primarily in mind. Coupling-off groups containing photographically useful groups such as development inhibitors, bleach accelerators etc. as a primary function, while usable, are not contemplated as coupling-off groups of primary concern for this image coupler. Generally preferred for X are nitrogen containing heterocyclic coupling-off groups, particularly those of formulas III and IV, defined below:

III

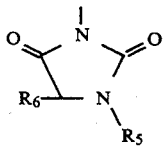

IV

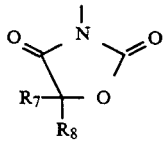

wherein:

$R_5$ is a substituted or unsubstituted alkyl group (including an arylalkyl group, such as benzyl); examples of suitable alkyl groups are methyl, ethyl, propyl, isopropyl, butyl, hexyl, cyclohexyl, octyl and dodecyl.

$R_6$ is hydrogen or a substituted or unsubstituted alkyl group or alkoxy group and is preferably a hydrogen or alkoxy group, most preferably a hydrogen; examples of suitable groups are methyl, ethyl, hexyl, methoxy, ethoxy and butoxy.

$R_7$ and $R_8$ are individually hydrogen or substituted or unsubstituted alkyl. Preferably at least one of $R_7$ and $R_8$ is an alkyl group.

Examples of sulfonate-substituted acylacetanilide yellow-dye forming imaging couplers useful for the practice of this invention include, but are not limited to, the following (I1–I23):

I1

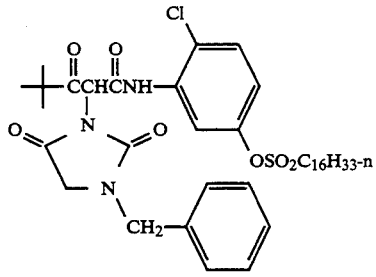

I2

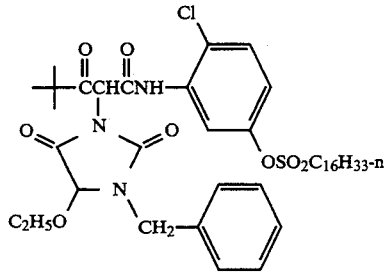

I3

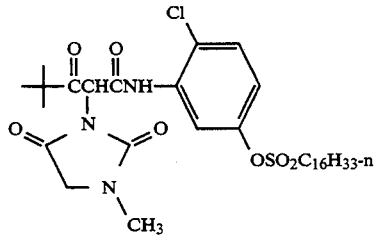

I4

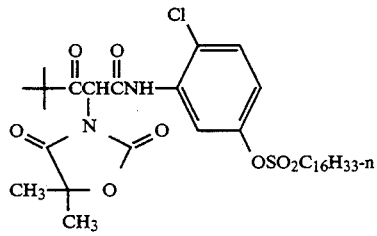

-continued
I5
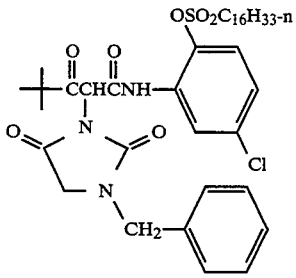
I6
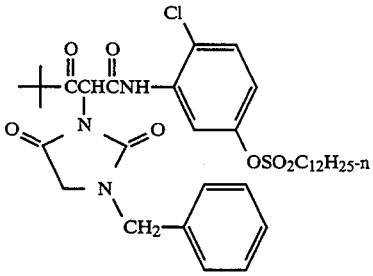
I7
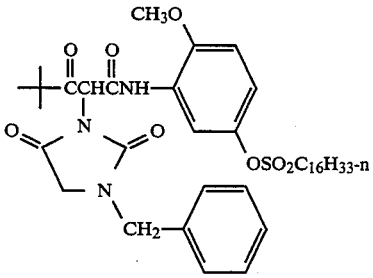
I8
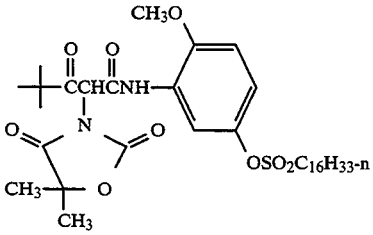
I9
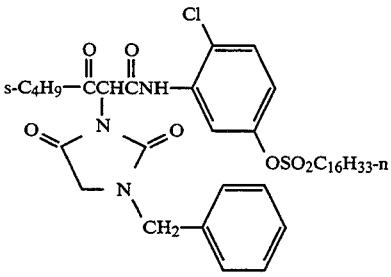
I10
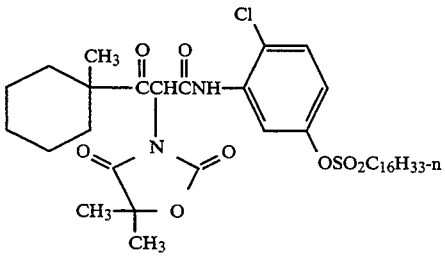
-continued
I11
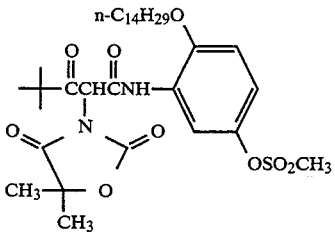
I12
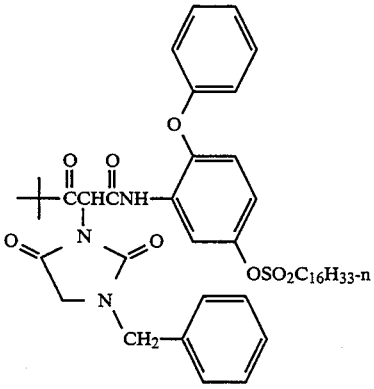
I13
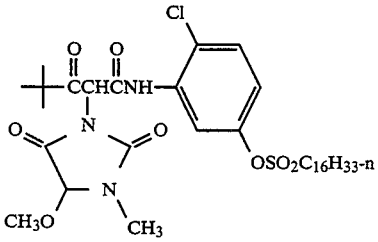
I14
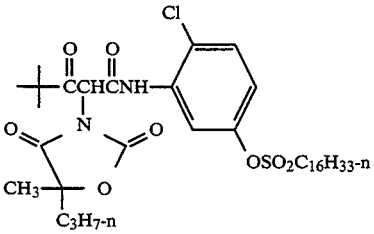
I15
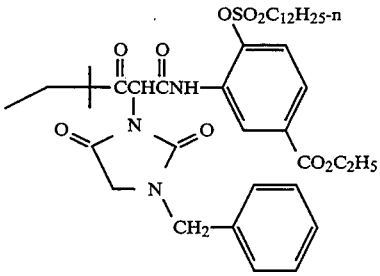

-continued

I16

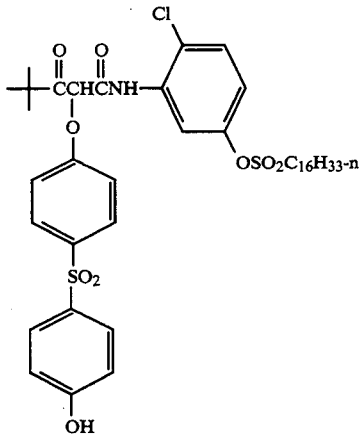

I17

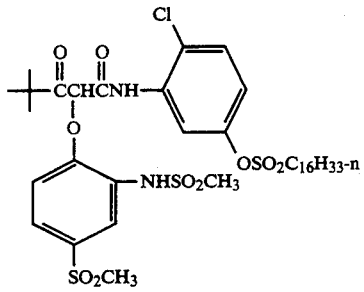

I18

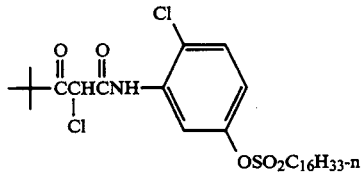

I19

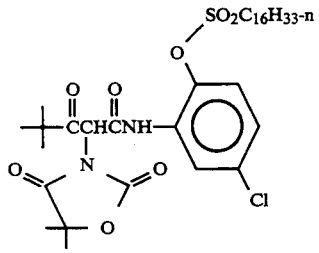

I20

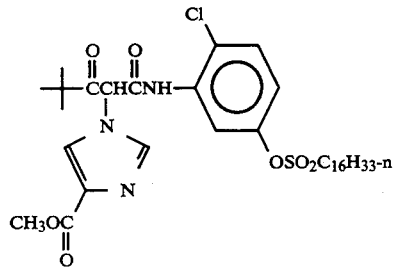

-continued

I21

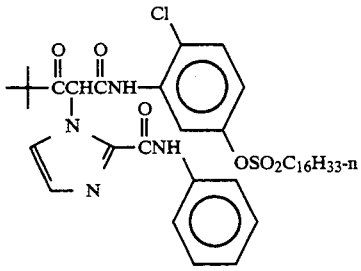

I22

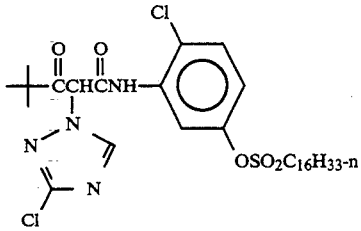

I23

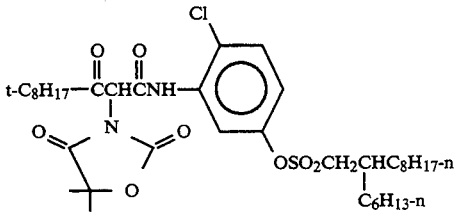

The DIR couplers useful for the practice of this invention are represented by general formulas V and VI, below:

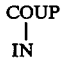

V

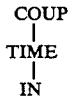

VI wherein:

COUP is a parent coupler moiety or residue that can couple with oxidized developer to form a dye. A coupler parent that yields a yellow dye on reaction with oxidized developer is typically employed.

IN is an inhibitor moiety that is joined either directly to the coupling site of COUP or through a timing group ("TIME") and is released with or without delay upon COUP reacting with oxidized developer; and TIME is a group that is bonded to the coupling site of COUP and to IN that allows release of TIME-IN upon COUP reacting with oxidized developer; the release of IN from TIME-IN may or may not entail a significant time delay.

Development inhibitor moieties IN useful for the DIR couplers of this invention include oxazoles, thiazoles, diazoles, triazoles, oxadiazoles, thiadiazoles, oxathiazoles, thiatriazoles, imidazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, tellurotetrazoles and benzisodiazoles Particularly useful are IN moieties of structures VII, VIII, IX, X, XI, XVII, and XVIII below:

VII

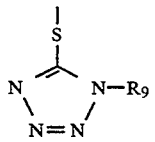

VIII

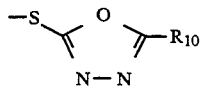

IX

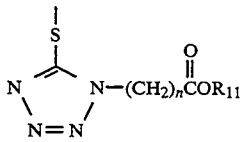

X

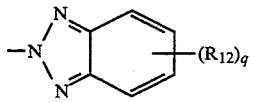

XI

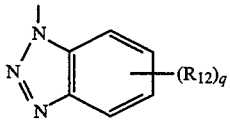

XVII

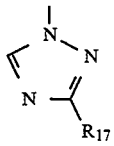

XVII

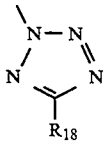

wherein:

$R_9$ is selected from the group consisting alkyl groups containing from 1 to 8 carbon atoms (including benzyl groups) and phenyl groups. When said groups are substituted, alkoxy substituents are preferred.

$R_{10}$ is selected from —$R_9$ and —$SR_9$;

$R_{11}$ is an alkyl group containing 1 to 5 carbon atoms.

n is from 1 to 3; and $R_{12}$ is selected from the group consisting of hydrogen, halogen, alkoxy, phenyl, —$COOR_{13}$ and —$NHCOR_{13}$, wherein $R_{13}$ is an alkyl group or a phenyl group.

For preferred DIR couplers of this invention IN is an inhibitor moiety of structure XI.

It is generally desirable to select a DIR coupler having an IN group which is hydrolyzable as shown in U.S. Pat. No. 4,477,503, which is incorporated herein by reference. For preferred DIR couplers of this invention where a timing group is present, IN is an inhibitor moiety of structure IX. Preferred couplers of the invention without a timing group are where IN has formula X or XI in which $R_{12}$ is —$COOR_{13}$ and $R_{13}$ is an alkyl or phenyl group and q is 1.

DIR couplers which release a weak diffusible inhibitor or which release a diffusible timing group/inhibitor combination are most effective in the invention. Weak inhibitors are those having an inhibitor strength of less than 60 as defined for example in U.S. Pat. No. 5,006,448, which is incorporated herein by reference. Where the inhibitor is attached directly to the parent group, use of an inhibitor group based on a benzotriazole is preferred.

DIR couplers with timing groups (DIAR couplers) are also desirable for use in combination with the yellow dye-forming imaging couplers of this invention. Timed inhibitor releasing groups, TIME-IN, useful for the practice of this invention include, but are not limited to those of structures XII, XIII, XIV, XV, and XVI, below:

XII

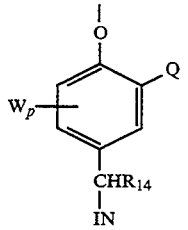

XIII

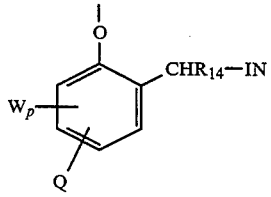

XIV

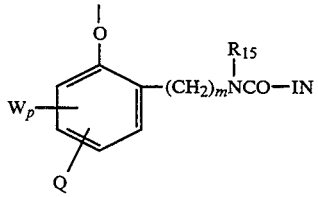

XV

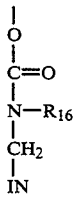

XVI

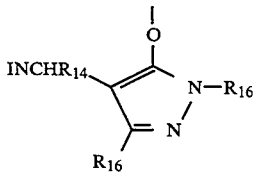

wherein:

Q and W are electron-withdrawing groups, examples of which include nitro, cyano, sulfonamido, sulfamoyl, alkylsulfonyl or carbamoyl groups or halogen atoms, such as chlorine.

p is 0, 1 or 2;

m is 0 or 1;

$R_{14}$ is hydrogen or an alkyl group;

$R_{15}$ is an alkyl group containing 1 to 8 carbon atoms or a phenyl group;

$R_{16}$ is an alkyl group or a phenyl group; and

IN is an inhibitor moiety, such as those defined by formulas VII-XI, above.

Useful timed inhibitor releasing groups for the DIR couplers of this invention also include heterocyclic groups, such as those disclosed in U.S. Pat. No. 4,421,845, and in JP-A-57-188035 JP-A-58-209736, JP-A-58-209737 and JP-A-58-209738.

Preferred DIR couplers for the practice of this invention include those of structures XII in which Q is a nitro group, $R_{14}$ is hydrogen and IN is of structure VII or IX and those of structure XIV in which Q is nitro, m is 1, p is 0, $R_{15}$ is ethyl and IN is of structure VII or IX above.

Examples of DIR couplers useful for the practice of this invention include, but are not limited to, the following (D1–D24). When the IN formula includes the designation "(iso)" this indicates that the formula includes the isomers in which the benzotriazole is linked to the coupler at the 1, 2, or 3 position and mixtures thereof.

D1

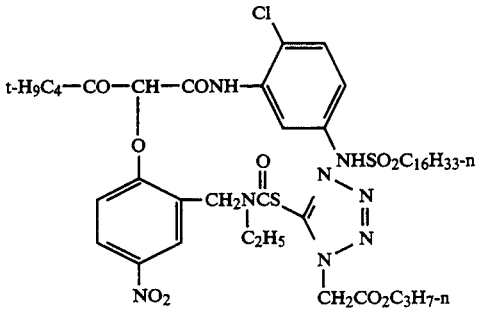

D2

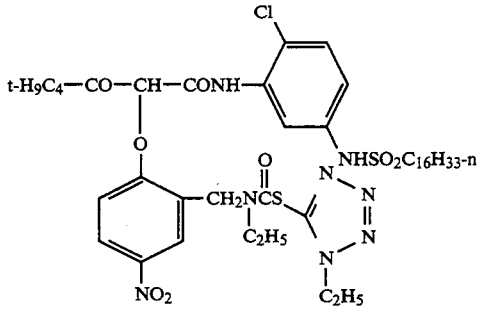

D3

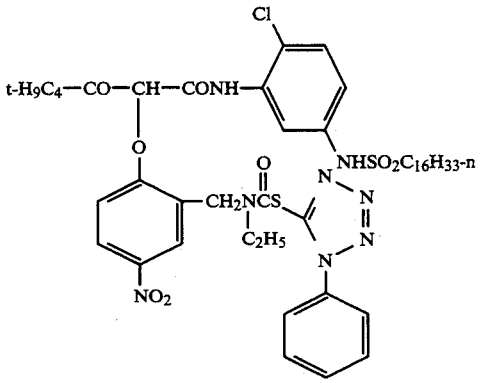

D4

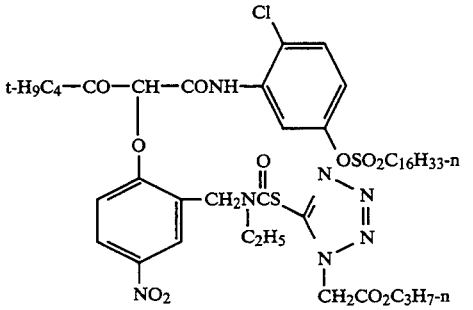

D5

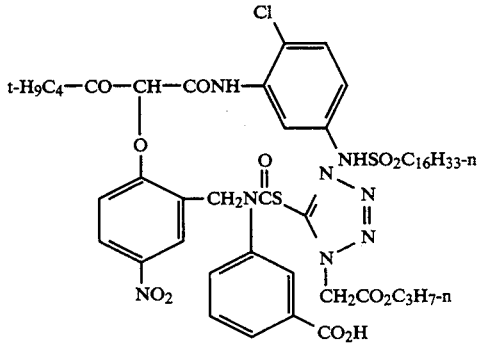

D6

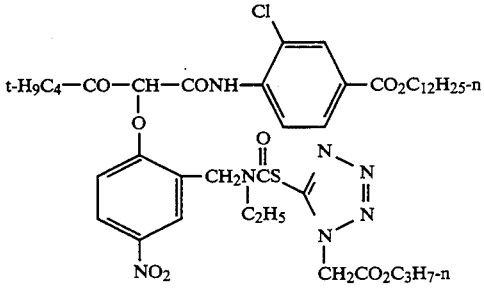

-continued
D7
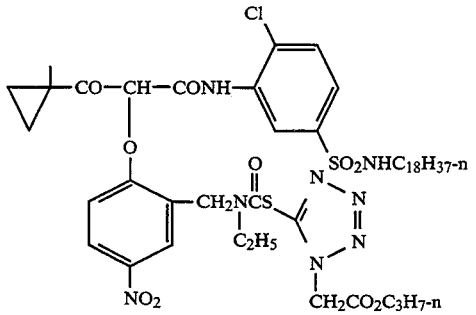
D8
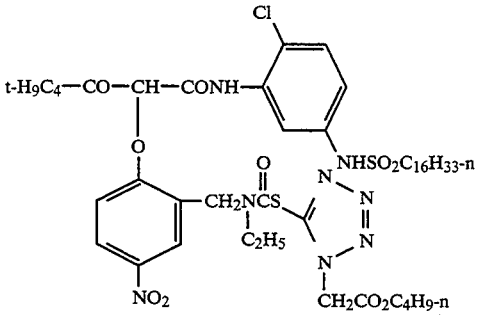
D9
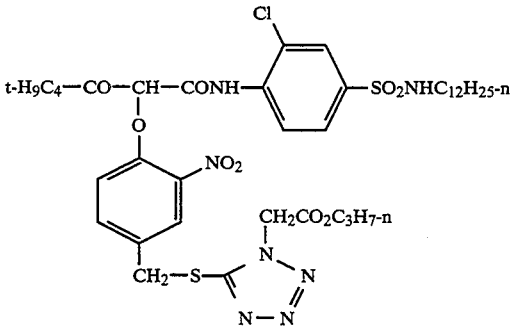
D10
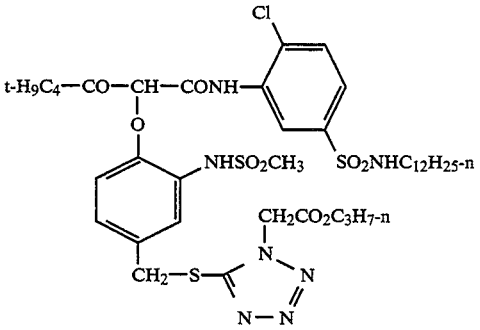
D11
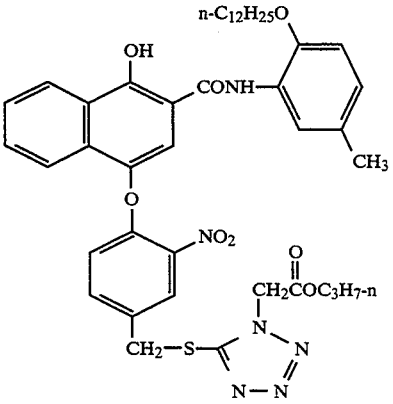
D12
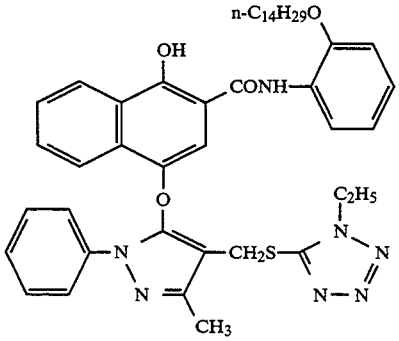
D13
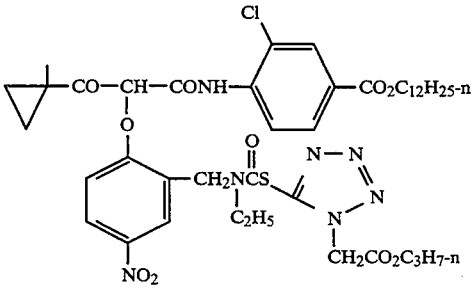
D14
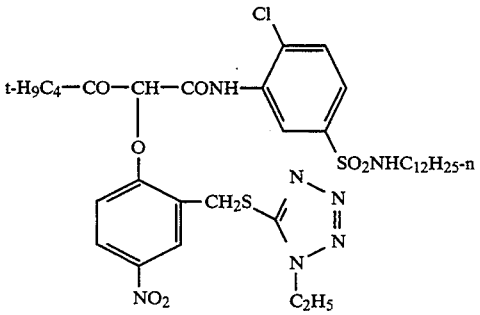

-continued
D15
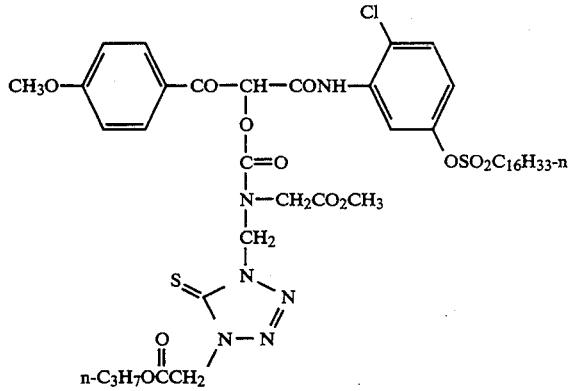
D16
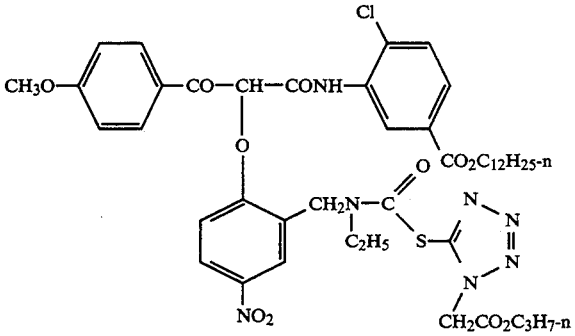
D17
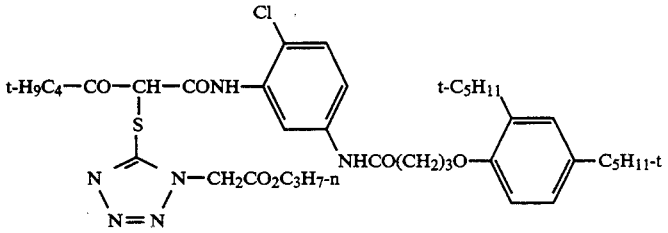
D18
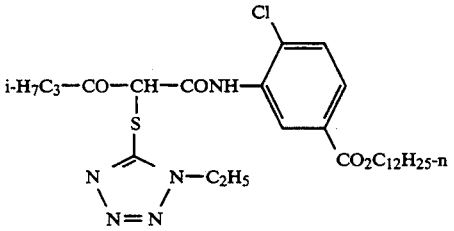
D19
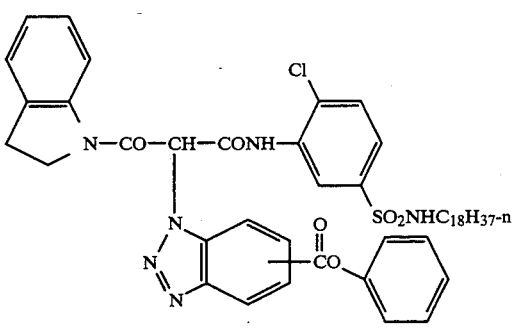
D20
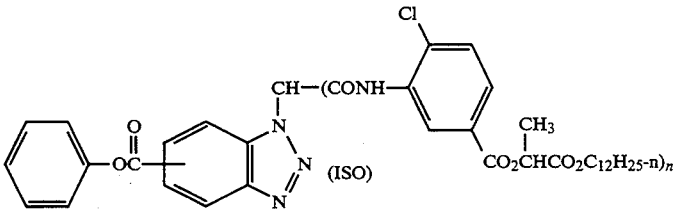

-continued

D21

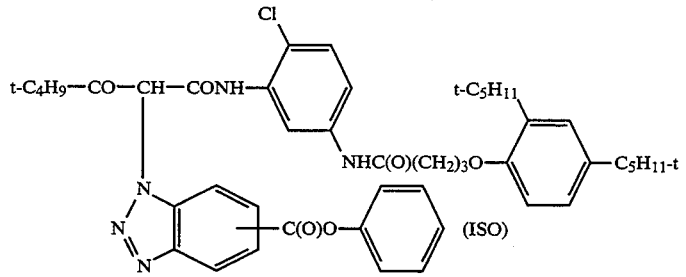

D22

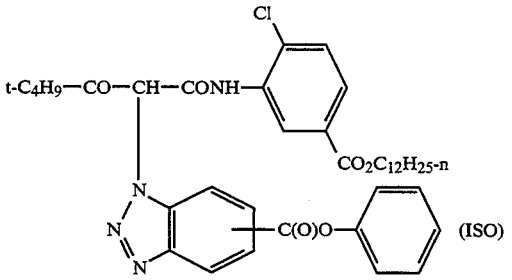

D23

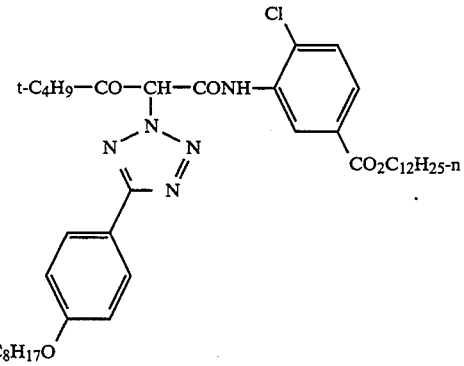

D24

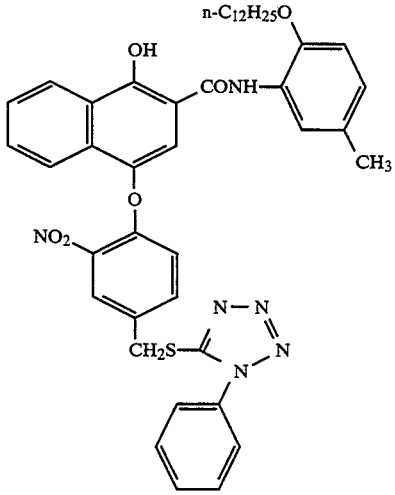

Useful coated levels of the sulfonate-substituted acylacetanilide yellow dye-forming imaging couplers of this invention range from about 0.05 to about 3.0 g/sq m, or more typically from 0.10 to 2.0 g/sq/m. Useful coated levels of the DIR couplers of this invention range from about 0.01 to about 1.00 g/sq m, or more typically from 0.02 to 0.50 g/sq m. Useful coated mole ratios of the sulfonate-substituted acylacetanilide yellow dye-forming imaging couplers of this invention to the DIR couplers range from about 1:0.01 to about 1:2, or more typically from about 1:0.03 to about 1:1.

The couplers of this invention are usually utilized by dissolving them in high-boiling coupler solvents and then dispersing the organic coupler plus coupler solvent mixtures as small particles in aqueous solutions of gelatin and surfactant (via milling or homogenization). Removable auxiliary organic solvents such as ethyl acetate or cyclohexanone may also be used in the preparation of such dispersions to facilitate the dissolution of the coupler in the organic phase. Coupler solvents useful for the practice of this invention include aryl phosphates (e.g. tritolyl phosphate), alkyl phosphates (e.g. trioctyl phosphate), mixed aryl alkyl phosphates (e.g. diphenyl 2-ethylhexyl phosphate), aryl, alkyl or mixed aryl alkyl phosphonates, phosphine oxides (e.g. trioctylphosphine oxide), esters of aromatic acids (e.g. dibutyl phthalate, octyl benzoate, or benzyl salicylate) esters of aliphatic acids (e.g. acetyl tributyl citrate or dibutyl sebecate), alcohols (e.g. 2-hexyl-1-decanol), phenols (e.g. p-dodecylphenol), carbonamides (e.g. N,N-dibutyldodecanamide or N-butylacetanilide), sulfoxides (e.g. bis(2-ethylhexyl)sulfoxide), sulfonamides (e.g. N,N-dibutyl-p-toluenesulfonamide) or hydrocarbons (e.g. dodecylbenzene). Additional coupler solvents and auxiliary solvents are noted in Research Disclosure, December 1989, Item 308119, p 993. Useful coupler:coupler solvent weight ratios range from about 1:0.1 to 1:8.0, with 1:0.2 to 1:4.0 being preferred. Examples of DIAR couplers useful for the practice of this invention include, but are not limited to, the following (D1–D20):

It is advantageous that the invention provides a photographic element in which the yellow dye-forming coupler has high reactivity and forms dyes efficiently when used in combination with DIR couplers. The element maintains high blue gamma or contrast in one or more yellow dye- forming layers while effectively reducing gamma in adjacent layers as a function of blue exposure. Further, the element yields a dye of the proper hue which has good stability, especially good stability toward heat.

For optimum intralayer and interlayer effectiveness it is desirable that the reactivities of an imaging coupler and the associated DIR be properly balanced. As used herein associated means that the imaging coupler and DIR coupler are coated either in the same layer or in an adjacent layer having the same spectral sensitivity or in an interlayer adjacent to the layer containing the yellow dye-forming coupler. If the imaging coupler is too inactive relative to the DIR coupler, all of the DIR coupler is used up at low exposures. If the imaging coupler is too active relative to the DIR coupler, the DIR coupler cannot compete effectively for oxidized developer and thus the inhibitor is not released efficiently.

As will be discussed in the Examples, combinations of yellow dye-forming couplers and DIR couplers are desired that maintain suitable gamma in the yellow image dye-forming layer (referred to as the causer layer) while effectively reducing gamma in layers of different spectral sensitivity (referred to as receiver layers), particularly green-light sensitive magenta dye-forming layers. Thus, it is desirable to identify yellow dye-forming imaging couplers that may be combined in reactive association with DIR couplers such that the coupler activities are balanced and such that high intralayer gamma is maintained while interlayer inhibition causes the gamma in one or more receiver layers to be efficiently reduced. Furthermore it is desirable that the yellow dye-forming imaging coupler/DIR combinations yield dyes having the proper hue and good stability.

The materials of the invention can be used in any of the ways and in any of the combinations known in the art. Typically, the invention materials are incorporated in a silver halide emulsion and the emulsion coated as a layer on a support to form part of a photographic element.

To control the migration of various components, it may be desirable to include a high molecular weight hydrophobe or "ballast" group in the component molecule. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND.

In the following discussion of suitable materials for use in the emulsions and elements of this invention, reference will be made to *Research Disclosure,* December 1989, Item 308119, available as described above, which will be identified hereafter by the term "Research Disclosure." The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections VII and XXI. Vehicles are described in Section IX, and various additives such as brighteners, antifoggants, stabilizers, light absorbing and scattering materials, hardeners, coating aids, plasticizers, lubricants and matting agents are described , for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,6 44,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3- position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application A-113935. The masking couplers may be shifted or blocked, if desired.

For example, in a color negative element, the materials of the invention may replace or supplement the materials of an element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1-imidazolidinyl)-3-(4-methoxyphenyl)-1,3-dioxopropyl-)amino)-, dodecyl ester and a slow yellow layer containing the same compound together with "Coupler 2": Propanoic acid, 2- [[5- [[4- [2- [[[2,4-bis (1,1-dimethylpropyl)phenoxy]acetyl]amino]-5-[(2,2,3,3,4,4,4-heptafluoro-1-oxobutyl)amino]-4-hydroxyphenoxy]-2,3-dihydroxy-6-[(propylamino)carbonyl ]phenyl]thio]-1,3,4-thiadiazol-2-yl]thio]-, methyl ester and "Coupler 3": 1-((dodecyloxy)carbonyl) ethyl(3-chloro-4-((3-(2-chloro-4-((1-tridecanoylethoxy) carbonyl)anilino)-3-oxo-2-((4)(5)(6)-(phenoxycarbonyl)-1H-benzotriazol-l-yl)propanoyl)amino))benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-,"Coupler 5": Benzamide, 3-((2-(2,4-bis(1,1-dimethylpropyl)phenoxy)-1-oxobutyl)amino)-N-(4',5'-dihydro-5'-oxo-1'-(2,4,6-trichlorophenyl) (1,4'-bi-1H-pyrazol)-3'-yl)-,"Coupler 6": Carbamic acid, (6-(((3-(dodecyloxy)propyl) amino)carbonyl)-5-hydroxy-1-naphthalenyl)-, 2-methylpropyl ester , "Coupler 7"Acetic acid, ((2-((3-(((3-(dodecyloxy)propyl)amino) carbonyl)-4-hydroxy-8-(((2-methylpropoxy)carbonyl) amino) -1-naphthalenyl)oxy) ethyl) thio) -, and "Coupler 8" Benzamide, 3-((2- (2,4-bis(1,1-dimethylpropyl) phenoxy) -1-oxobutyl)amino)-N-(4,5-dihydro-4-((4-methoxyphenyl) azo)-5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)-4,5-dihydro-5-oxo-1H-pyrazol-3-yl]-2-methyl-2-propenamide; and "Coupler 10". Tetradecanamide, N-(4-chloro-3-((4-((4-((2,2-dimethyl-1-oxopropyl) amino)phenyl)azo)-4,5-dihydro-5-oxo-1-(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy) propyl)amino)carbonyl)-4-hydroxy-1-naphthalenyl) oxy)ethoxy)phenyl)azo)-4-hydroxy-, disodium salt; and a slow cyan layer containing Couplers 2 and 6;

(7) an undercoat layer containing Coupler 8; and (8) an antihalation layer.

In a reversal format, the materials of the invention may replace or supplement the materials of an element comprising a support bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4-(1-(((2-chloro-5-((dodecylsulfonyl)amino)phenyl) amino)carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast magenta layer containing "Coupler 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coupler 4": Benzamide, 3-((2-(2,4-bis(1,1-dimethylpropyl )phenoxy)-1-oxobutyl)amino)-N-(4,5-dihydro-5-oxo-1-( 2,4,6-trichlorophenyl)-1H-pyrazol-3-yl)-; and "Coupler 5": Benzamide, 3-(((2,4-bis(1,1-dimethylpropyl )phenoxy)acetyl)amino)-N-(4,5-dihydro-5-oxo-1-(2,4,6-trichlorophenyl)-1H-pyrazol-3-yl)-; and containing the stabilizer 1,1'-Spirobi(1H-indene), 2,2',3,3'-tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4-heptafluoro-1-oxobutyl-)amino)-3-hydroxyphenyl)-; a mid cyan containing'-'Coupler 7": Butanamide, N-(4-((2-(2,4-bis(1,1-dimethylpropyl)phenoxy)-l-oxobutyl)amino)-2-hydroxyphenyl)-2,2,3,3,4,4,4-heptafluoro- and "Coupler 8": Hexanamide, 2-(2,4-bis(1,1-dimethylpropyl)phenoxy)-N-(4-((2,2,3,3,4,4,4-heptafluoro-1-oxobutyl)amino)-3-hydroxyphenyl)-;

(10) one or more interlayers possibly including fine-grained nonsensitized silver halide; and

(11) an antihalation layer.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

"Development Inhibitor-Releasing" compounds (DIRs) useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613. Such compounds are also disclosed in "Developer-Inhibitor-Releasing (DIR) Couplers for Color Photography," C.R. Barr, J.R. Thirtle and P.W. Vittum in *Photographic Science and Engineering,* Vol. 13, p. 174 (1969), incorporated herein by reference.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. Nos. 4,438,193; 4,618,571) and groups that combine the features describe above.

The element of the invention is suitably used with a bromoiodide silver halide emulsion. Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.06$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(β-(methanesulfonamido) ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

It is understood thoroughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form further substituted with any substitutent that does not harm the photographic properties of the element. Usually the further substituent will have less than 30 carbon atoms and typically less than 20 carbon atoms.

Synthesis of the yellow dye-forming coupler of the invention is well-known in the art. They may be made, for example, by condensing a suitably substituted aniline with methyl pivaloyl acetate (MPA) in a high boiling point solvent such as n-heptane during which methanol is removed azeotropically.

The coupling-off group is attached to the 4equivalent parent coupler via the intermediacy of a chloro derivative which is obtained by treating the parent coupler with a suitable chlorinating agent such as sulfuryl chloride. The chloro substituent is then displaced by the anion of the coupling-off group. This conversion can be undertaken in a polar solvent such as acetonitrile using an organic base such as triethylamine to ionize the coupling-off group. U.S. Pat. No. 4,022,620 discloses this methodology and is incorporated herein by reference.

The sulfonated acylacetanilide yellow dye-forming imaging coupler and DIR coupler combinations of this invention may be used together with a variety of other types of couplers in the same layer or in different layers of a multilayer photographic material. Specifically contemplated is the use of the acylacetanilide yellow dye-forming imaging coupler and DIR coupler combinations of this invention together with one or more benzoylacetanilide yellow dye-forming imaging couplers, such as those described in U.S. Pat. Nos. 3,973,968 or 4,022,620 in the same layer or in an adjacent layer. Also specifically contemplated is the use of the acylacetanilide yellow dye-forming coupler and DIR coupler combinations of this invention in one or more blue sensitive layers together with one or more green sensitive layers containing at least one two-equivalent 1-phenyl-3-anilino-5-pyrazolone magenta dye-forming coupler.

EXAMPLE 1

Comparative Evaluation of Coupler Plus DIR Coupler Combinations of the Invention To illustrate the advantages of the inventive acylacetanilide coupler/DIR coupler combinations, the simple multilayer test format shown below was utilized. The test film includes a so-called causer layer containing acylacetanilide imaging coupler/DIR coupler combinations of this invention and a silver bromoiodide emulsion, an interlayer with a scavenger for oxidized developer and a receiver layer with a magenta dye forming coupler and a silver bromoiodide emulsion. As will be elaborated subsequently, measurement of the ratio of blue:green gamma following exposure and processing provides an indication of the effectiveness of the combinations of couplers used in the causer layer.

| Multilayer Test Film Structure | |
|---|---|
| Gel Overcoat: | Gelatin @ 1.50 g/sq m<br>Bis(vinylsulfonyl)methane hardener @ 0.054 g/sq m |
| Causer Layer: | Acylacetanilide Yellow Dye-Forming Imaging Coupler @ 0.00147 mol/sq m<br>DIR Coupler D1 @ 0.247 g/sq m.<br>0.79 μm Silver Bromoiodide Emulsion (3% Iodide) @ 0.81 g Ag/sq m<br>Gelatin @ 1.6 g/sq m |
| Interlayer: | Oxidized Developer Scavenger A1 @ 0.171 g/sq m<br>Silver @ 0.058 g/sq m<br>Gelatin @ 2.20 g/sq m<br>Bis(vinylsulfonyl)methane hardener @ 0.076 g/sq m |
| Receiver Layer: | Magenta Dye-Forming Coupler A2 @ 0.86 g/sq m<br>0.46 μm Silver Bromoiodide Emulsion (6.4% Iodide) @ 1.08 g Ag/sq m<br>Gelatin @ 1.60 g/sq m |
| Antihalation Layer: | Grey silver @ 0.30 g/sq m<br>Gelatin @ 2.40 g/sq m |
| Transparent Support: | Cellulose Acetate |

Structural formulas for A1 and A2 in the above coating diagram and for comparison couplers C1, C2 and C3 are given below.

A1

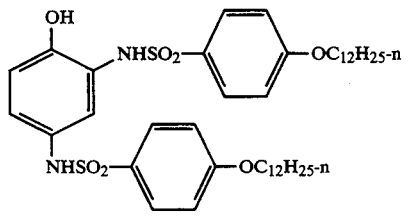

-continued

A2

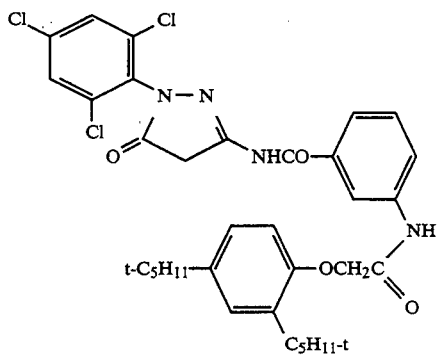

C1

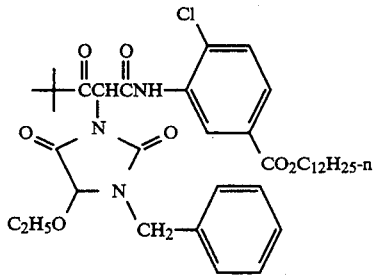

C2

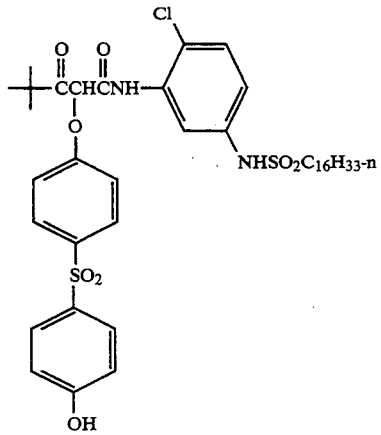

C3

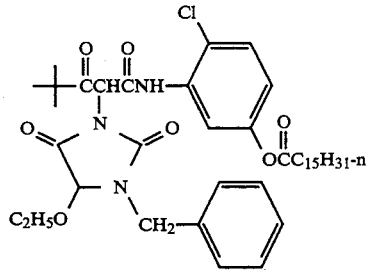

Aqueous dispersions of the couplers were prepared by methods known in the art. The acylacetanilide yellow-dye forming imaging coupler dispersions contained 6% by weight of gelatin, 9% by weight of coupler and a 1:0.5:1.5 weight ratio of coupler to di-n-butyl phthalate coupler solvent to cyclohexanone auxiliary solvent. The auxiliary solvent was included to aid in dispersion preparation and was removed by washing the dispersion for 6 hr at 4° C. and pH 6 prior to coating. The dispersion of DIR coupler D1 was prepared with 7% by weight of gelatin, 6% by weight of coupler and a 1:1:2 weight ratio of D1 to di-n-butyl phthalate to 2-(2-butoxyethoxy)ethyl acetate auxiliary solvent. The auxiliary solvent was removed by washing for 6 hr at 4° C. and pH 6. The dispersion of coupler A2 was prepared with 6% by weight of gelatin, 8.8% by weight of coupler and a 1:0.5:1.5 weight ratio of coupler to tri-cresyl phosphate coupler solvent to 2-(2-butoxyethoxy) ethyl acetate. The later was removed by washing for 6 hr at 4° C. and pH 6 prior to coating.

The coatings were slit into 30 cm×35 mm strips. After hardening the strips were exposed through a 0–4 neutral density step wedge (0.2 density increments), Daylight V and Wratten 2B filters. The exposed strips were than processed through a standard C-41 process using the following processing times:

| | |
|---|---|
| Developer | 2.5 min |
| Bleach | 4.0 min |
| Wash | 2.0 min |
| Fix | 4.0 min |
| Wash | 2.0 min |

For each processed strip, Status M blue and green densities were measured as a function of exposure. Values for Status M blue gamma or contrast (Blue Gamma) and Status M green gamma or contrast (Green Gamma) were obtained from the slopes of plots of density vs log exposure. Values for Blue Gamma and Green Gamma are listed in Table I. When both the causer and the receiver layers are exposed and developed, a film with a desirable combination of yellow dye-forming imaging coupler and DIR coupler will yield a high blue gamma and a substantial reduction in green gamma (due to the interlayer interimage effect resulting from diffusion of the released inhibitor into the magenta dye-forming layer). An active DIR coupler is required in the causer layer to efficiently reduce green gamma in the receiver layer, and an active yellow dye-forming imaging coupler is also required in the causer layer to maintain efficient dye formation and suitably high blue gamma even with efficient inhibitor release. The ratio of Blue Gamma to Green Gamma (Gamma Ratio) is also listed in Table I and serves as a measure of the effectiveness of the combination of yellow dye-forming imaging coupler and DIR coupler. The higher the Gamma Ratio the better.

TABLE I

| Acylacetanilide Imaging Coupler Coated in Causer Layer with D1 | | Blue Gamma | Green Gamma | Gamma Ratio |
|---|---|---|---|---|
| A) | C1 Comparative Coupler | 0.59 | 0.57 | 1.04 |
| B) | C2 Comparative Coupler | 0.73 | 0.64 | 1.14 |
| C) | C3 Comparative Coupler | 0.65 | 0.63 | 1.03 |
| D) | I1 Invention | 0.75 | 0.57 | 1.32 |
| E) | I2 Invention | 1.15 | 0.69 | 1.67 |
| F) | I4 Invention | 0.73 | 0.43 | 1.70 |
| G) | I16 Invention | 0.79 | 0.48 | 1.65 |

It is evident from the data in Table I that all of the acylacetanilide imaging coupler/DIR coupler combinations of this invention yield desired increases in the ratio of blue gamma to green gamma relative to the comparative acylacetanitide imaging coupler/DIR coupler combinations. In addition, combinations containing the sulfonate substituted acylacetanilide couplers of this invention yield higher Gamma Ratio values than obtained with comparative couplers with the same coupling-off groups. Specifically film E with coupler I2 of this invention yields a higher Gamma Ratio than films A or C, and film G with coupler I16 of this invention yields a higher Gamma Ratio than film B. The hue and dye stability provided by the coupler combinations of this invention were also found to be suitable.

EXAMPLE 2

Comparative Evaluation of Coupler/DIR Coupler Combination of the Invention in a Multilayer Color Negative Film The advantages of the novel acylacetanilide imaging coupler/DIR coupler combinations of this invention are further illustrated by comparative data for the product-type multilayer color negative films described below. The multilayer film structure is shown in the table. Dispersions of the various components were prepared and coated according to procedures known in the art. Component laydowns in g/sq m are listed in parentheses. In the table solid lines mark the boundaries between layers. Structural formulas of coated components not given previously are provided immediately after the table.

| Multilayer Structure for Example 2 | | |
|---|---|---|
| 1 | Overcoat Layer: | Matte Beads |
| | | UV Absorber UV-1 (0.111) & S-1 (0.111) |
| | | UV Absorber UV-2 (0.111) & S-1 (0.111) |
| | | CD-1 Cyan Dye (0.0067) & S-2 (0.0268) |
| | | Silver Bromide Lippmann Emulsion (0.215 Ag) |
| | | Gelatin (1.08) |
| | | Bis(vinylsulfonyl)methane Hardener (at 2% by weight of total Gelatin). |
| 2 | Fast Yellow Layer: | D1 (0.0497) (DIR) & S-2 (0.0497) |
| | | B-1 (0.0055) Coupler & S-3 (0.0055) |
| | plus { | C1 (0.435)(0.62 mmole/sq m)(Comparison) & S-2 (0.435) |
| | or { | I1 (0.461)(0.62 mmole/sq m)(Invention) & S-2 (0.461) |
| | | Silver Bromoiodide Emulsion (0.570 Ag), 9 mole % Iodide (1.0 μm) |
| | | Silver Bromoiodide Emulsion (0.226 Ag), 4 mole % Iodide T-Grain (3.0 × 0.14 μm) |
| | | Gelatin (1.97) |
| 3 | Slow Yellow Layer | D1 (0.0646) & S-2 (0.0646) |
| | | B-1 (0.0029) & S-3 (0.0029) |
| | plus { | C1 (1.35)(1.93 mmole/sq m)(Comparison) & S-2 (1.35) |
| | or { | I1 (1.43)(1.91 mmole/sq m)(Invention) & S-2 (1.43) |
| | | Silver Bromoiodide Emulsion (0.600 Ag), 6 mole % Iodide T-Grain (1.0 × 0.26 μm) |
| | | Silver Bromoiodide Emulsion (0.215 Ag), 1.3 mole % Iodide T-Grain (0.55 × 0.08 μm) |
| | | Gelatin (2.60) |
| 4 | Interlayer: | YD-2 Filter Dye (0.108) |
| | | Gelatin (1.29) |
| 5 | Fast Magenta Layer: | M-1(0.0646) Magenta Dye-Forming Coupler & S-4(0.0517) & ST-1 (0.0129) Addendum |
| | | MM-1 (0.0538) Masking Coupler & S-4 (0.108) |

-continued

| Multilayer Structure for Example 2 | | |
|---|---|---|
| | | IR-3 (0.0054) DIR & S-4 (0.0108) |
| | | IR-4 (0.0172) DIR & S-2 (0.0172) |
| | | Silver Bromoiodide Emulsion (0.968 Ag), 4 mole % Iodide T-Grain (2.16 × 0.12 μm) |
| | | Gelatin (1.33) |
| 6 | Mid Magenta Layer: | M-1 (0.0861) & S-4 (0.0689) & ST-1 (0.0172) |
| | | MM-1 (0.0646) & S-4 (0.129) |
| | | IR-3 (0.0054) & S-4 (0.0108) |
| | | IR-1 (0.0236) DIAR & S-5 (0.0572) |
| | | Silver Bromoiodide Emulsion (0.968 Ag), 4 mole % Iodide T-Grain (1.25 × 0.12 μm) |
| | | Gelatin (1.48) |
| 7 | Slow Magenta Layer: | M-1 (0.237) & S-4 (0.189) & ST-1 (0.0474) |
| | | MM-1 (0.0646) & S-4 (0.129) |
| | | Silver Bromoiodide Emulsion (0.613 Ag), 1.3 mole % Iodide T-Grain (0.55 × 0.08 μm) |
| | | Silver Bromoiodide Emulsion (0.269 Ag), 4 mole % Iodide T-Grain (1.00 × 0.09 μm) |
| | | Gelatin (1.78) |
| 8 | Interlayer: | YD-1 (0.108) Yellow Dye |
| | | Gelatin (1.29) |
| 9 | Fast Cyan Layer: | CC-1 (0.124) Cyan Dye-Forming Coupler & S-2 (0.124) |
| | | CM-1 (0.0323) Masking Coupler |
| | | IR-1 (0.0237) DIAR & S-5 (0.0574) |
| | | IR-2 (0.0484) DIR & S-4 (0.194) |
| | | Silver Bromoiodide Emulsion (1.08 Ag), 4 mole % Iodide T-Grain (2.6 × 0.13 μm) |
| | | Gelatin (1.36) |
| 10 | Mid Cyan Layer: | CC-1 (0.226) & S-2 (0.226) |
| | | CM-1 (0.0215) |
| | | IR-1 (0.0108) & S-5 (0.0216) |
| | | Silver Bromoiodide Emulsion (0.699 Ag), 4 mole % Iodide T-Grain (1.3 × 0.12 μm) |
| | | Gelatin (1.66) |
| 11 | Slow Cyan Layer: | CC-1 (0.538) & S-2 (0.538) |
| | | CM-1 (0.0323) |
| | | B-1 (0.0377) & S-3 (0.0377) |
| | | Silver Bromoiodide Emulsion (0.473 Ag), 1.3 mole % Iodide T-Grain (0.55 × 0.08 μm) |
| | | Silver Bromoiodide Emulsion (0.463 Ag), 4 mole % Iodide T-Grain (1.00 × 0.09 μm) |
| | | Gelatin (1.83) |
| 12 | Antihalation Layer: | Grey Silver (0.22 Ag) |
| | | Gelatin (2.44) |

Cellulose Triacetate Support

S-1

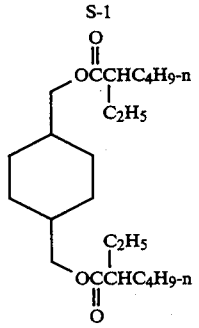

S-2

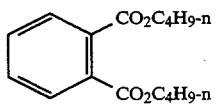

S-3

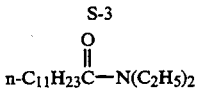

S-4

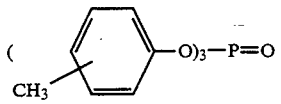

mixed isomers

S-5

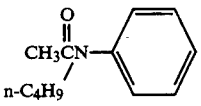

UV-1

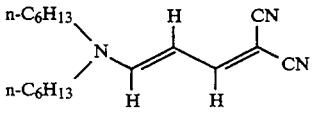

UV-2

CD-1

-continued
Multilayer Structure for Example 2
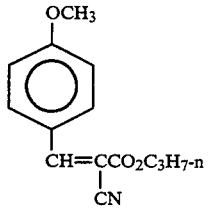
B-1
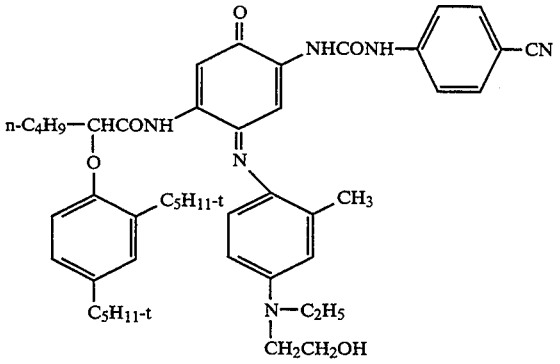
YD-2
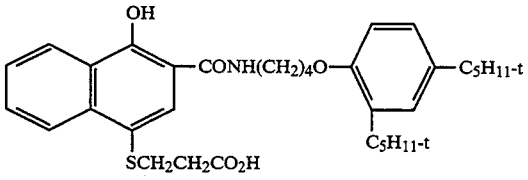
M-1
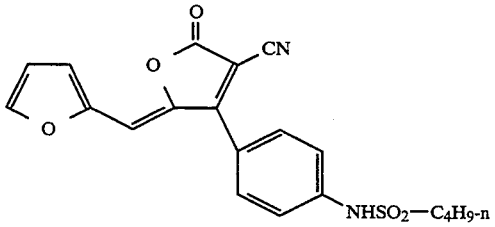
ST-1
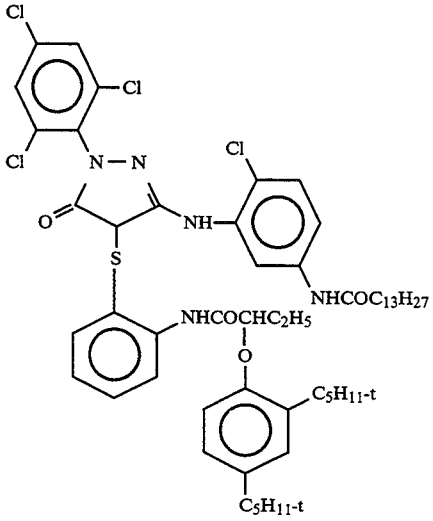
MM-1
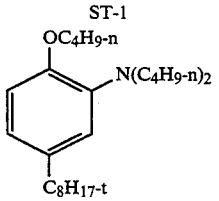
YD-1
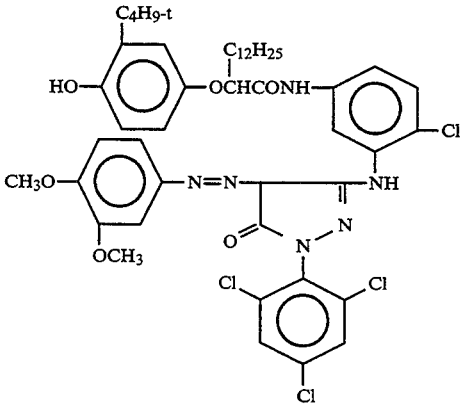
IR-1
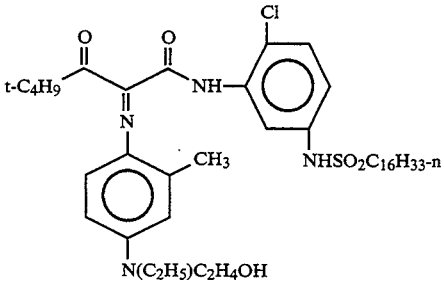
IR-2

-continued

Multilayer Structure for Example 2

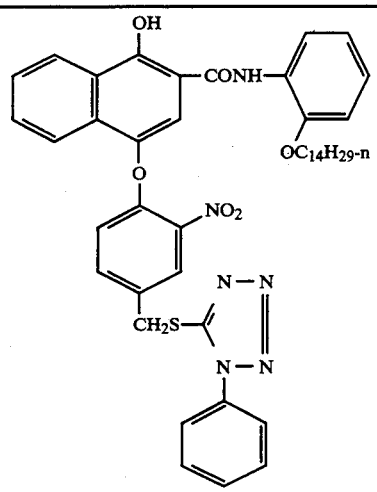

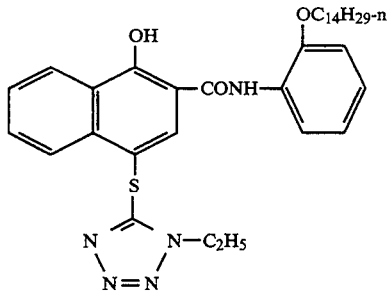

IR-3

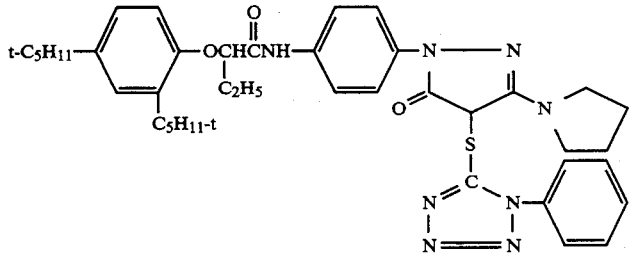

CC-1

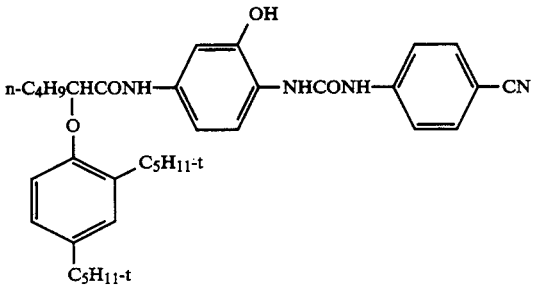

IR-4 (D20)

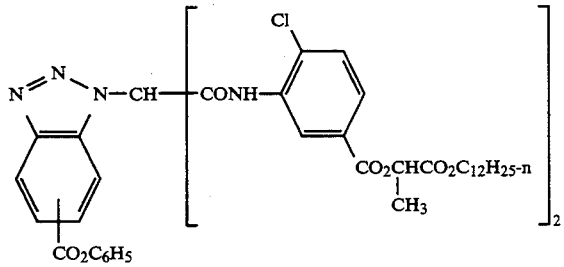

CM-1

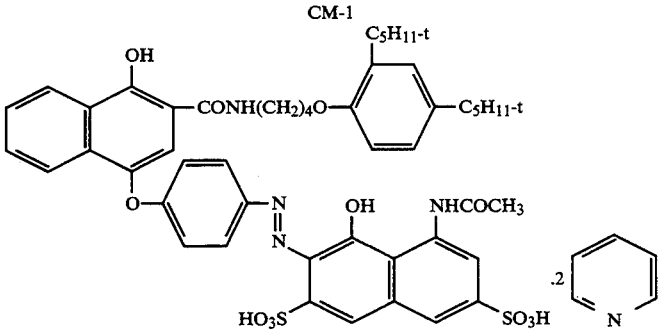

As indicated in the table, film sample A contains comparative yellow dye-forming imaging coupler C1 along with DIR coupler D1 in layers 2 and 3, whereas film sample B contains sulfonate substituted acylacetanilide yellow dye-forming coupler I1 of this invention together with DIR coupler D1. Couplers C1 and I1 were coated at equimolar laydowns. After hardening, samples of both films were given a neutral stepwise exposure and processed in a standard KODAK FLEXICOLOR C-41 color negative process. Status M densities were measured for each step of the processed film samples and plotted vs log of exposure. Gamma values were obtained from the slopes of the straight line portions of these plots. Blue and green gamma values (Blue Gamma & Green Gamma, respectively) are compared in Table II. As noted above, a high blue gamma relative to green gamma is desirable, since it indicates efficient dye formation in the blue layers and efficient onto-green interimage. As is evident from the data in Table II, the I1 plus D1 coupler combination of this invention gives a significantly higher Blue Gamma than the comparative combination C1 plus D1 at an equimolar laydown. This allows reduction in the coated levels of coupler and/or silver halide. Furthermore, the I1 plus D1 combination of this invention yields a slight reduction in Green Gamma, reflecting a desirable increase in onto-green interimage.

TABLE II

| | Multilayer Film | Midscale Blue Gamma | Midscale Green Gamma | Blue Green Ratio |
|---|---|---|---|---|
| A) | C1 plus D1 (Comparison) | 0.687 | 0.571 | 1.20 |
| B) | I1 plus D1 (Invention) | 0.818 | 0.541 | 1.51 |

The preceding examples are set forth to illustrate specific embodiments of this invention and are not intended to limit the scope of the materials or combinations of this invention. Additional embodiments and advantages within the scope of the claimed invention will be apparent to one skilled in the art.

What is claimed is:

1. A photographic element comprising a support bearing a blue-light sensitive silver halide emulsion layer containing an acylacetanilide yellow image dye-forming coupler having formula I or II:

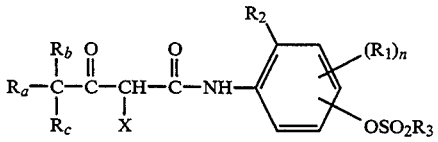

I

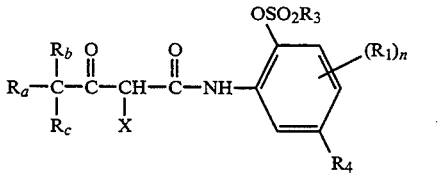

II wherein:

$R_a$ is an alkyl group, alkoxy group or aryloxy group;

$R_b$ is an alkyl or aryl group;

$R_c$ is hydrogen or an alkyl group;

$R_1$ is a substituent;

n is an integer from 0 to 2;

$R_2$ is selected from the group consisting of halogen, trifluoromethyl, alkoxy and aryloxy;

$R_3$ is alkyl;

$R_4$ is hydrogen, halogen, alkoxy carbonyl (—$CO_2R$), carbamoyl (—CONRR'), carbonamido (—NRCOR'), sulfonamido (—$NRSO_2R'$) or trifluoromethyl; where R and R' are alkyl groups;

X is hydrogen or a coupling-off group;

in formula I, the —$OSO_2R_3$ substituent is located in the -4 or -5 position relative to the anilino nitrogen; provided that each of R, R', $R_a$, $R_b$, $R_c$, $R_1$, $R_2$, $R_3$, $R_4$ and X having a substitutable hydrogen may have substituted for said hydrogen a substituent selected from the group consisting of halogen, nitro; hydroxyl; cyano; carboxyl; alkyl; alkenyl; alkoxy; aryl; aryloxy; carbonamido; sulfonamido; sulfamoyl; carbamoyl; acyl; sulfonyl; sulfonyloxy; sulfinyl; thio; acyloxy; amine; imino; phosphate; phosphite; heterocyclic group, heterocyclic oxy group, or heterocyclic thio group each of which may be substituted and which contain a 3 to 7 membered heterocyclic ring composed of carbon atoms and at least one hetero atom selected from the group consisting of oxygen, nitrogen and sulfur; quaternary ammonium; and silyloxy; wherein substitutable hydrogens on said substituents may themselves be suitably further substituted with any of the above substituent groups;

and wherein the blue-light sensitive silver halide emulsion layer has associated therewith a development inhibitor releasing coupler.

2. The photographic element of claim 1 wherein $R_a$, $R_b$, and $R_c$ are independently selected alkyl groups.

3. The photographic element of claim 2 wherein $R_a$, $R_b$, and $R_c$ are each a methyl group.

4. The photographic element of claim 1 wherein X is selected from the group consisting of aryloxy and heterocyclic groups wherein X may DO substituted as provided for $R_1$.

5. The photographic element of claim 4, wherein X is a heterocyclic coupling-off group having formula III or IV:

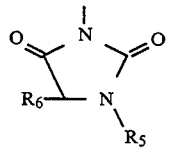

III

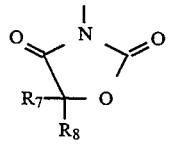

IV wherein:

$R_5$ is an alkyl group;

$R_6$ is selected from the group consisting of hydrogen, alkyl and alkoxy;

$R_7$ and $R_8$ are independently selected from the group consisting of hydrogen and alkyl wherein $R_5$, $R_6$, $R_7$, and $R_8$ may be substituted as provided for $R_1$.

6. The photographic element of claim 5, wherein at least one of $R_7$ and $R_8$ is an unsubstituted alkyl group.

7. The photographic element of claim 6, wherein said at least one unsubstituted alkyl group is a methyl group.

8. The photographic element of claim 1, wherein $R_a$, $R_b$, $R_c$, $R_1$, $R_2$, $R_3$, R4,and X, taken together for the applicable formula I or II, have at least 12 carbon atoms.

9. The photographic element of claim 1 wherein $R_a$, $R_b$, $R_c$, $R_1$, $R_2$, $R_3$, and $R_4$, taken together for the applicable formula I or II, have at least 9 carbon atoms.

10. The photographic element of claim 1, wherein the coated level of said coupler of formula I or II is 0.05 to 3.0 g/sq m.

11. The photographic element of claim 5, wherein $R_6$ is hydrogen or an alkoxy group which may be substituted as provided for 12. The photographic element of claim 5, wherein at least one of $R_7$ and $R_8$ is an alkyl group which may be substituted as provided for $E_1$.

13. The photographic element of claim 12, wherein $R_7$ and $R_8$ are methyl.

14. The photographic element of claim 1, wherein $R_2$ is chloro and $R_3$ is n-hexadecyl.

15. The photographic element of claim 1, wherein the acylacetanilide yellow-dye forming imaging coupler has a formula selected from the group consisting of

I1

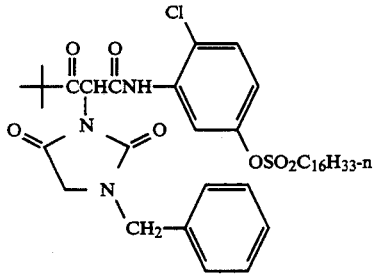

I2

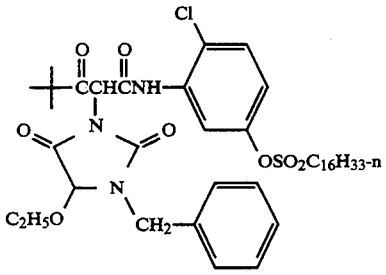

I3

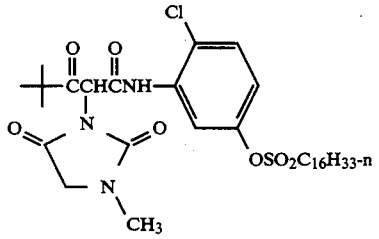

I4

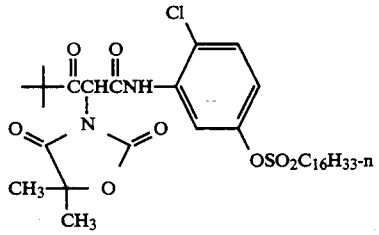

I5

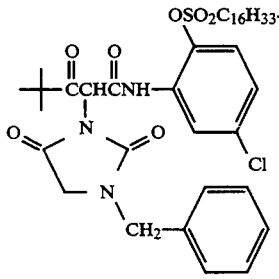

-continued

I6

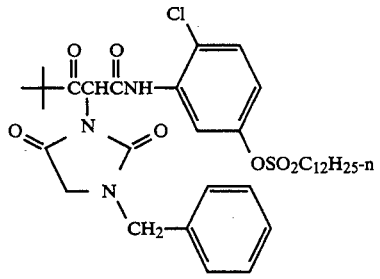

I7

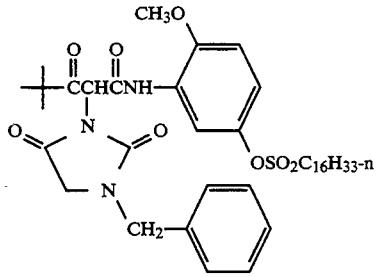

I8

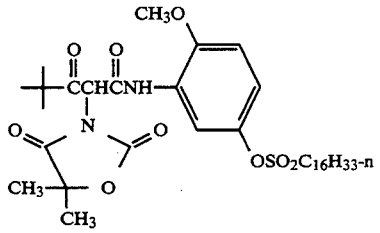

I9

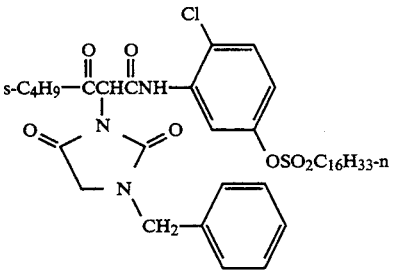

I10

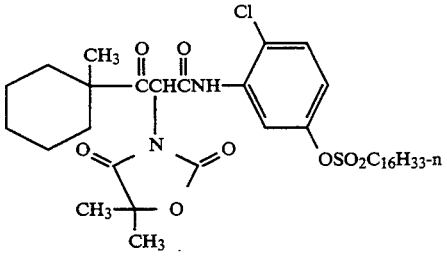

I11

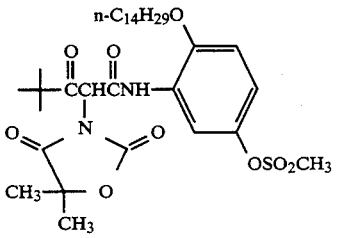

-continued
I12
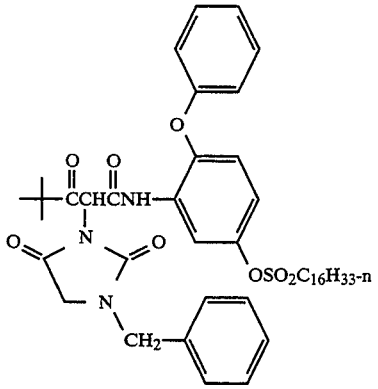
I13
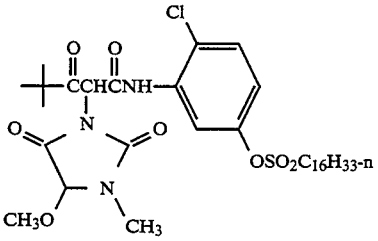
I14
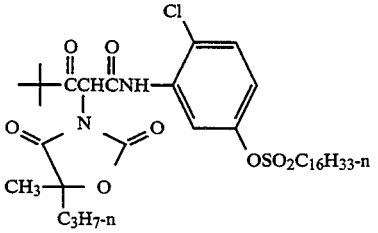
I15
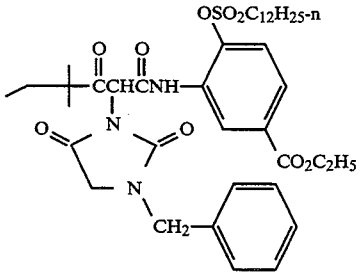
I16
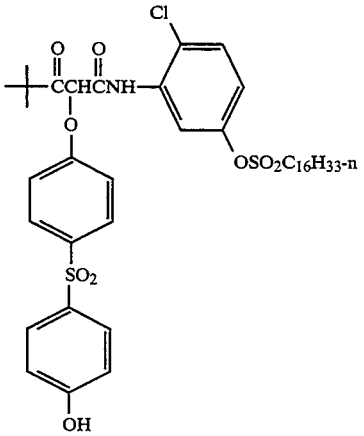
-continued
I17
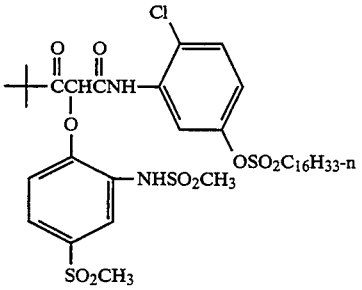
I18
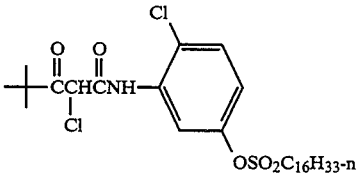
I19
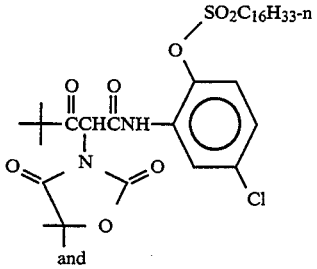
and
I20
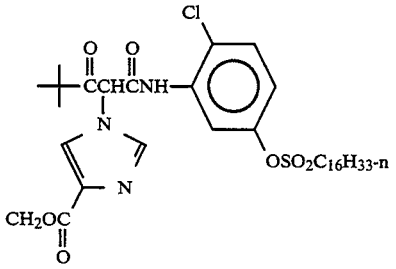
I21
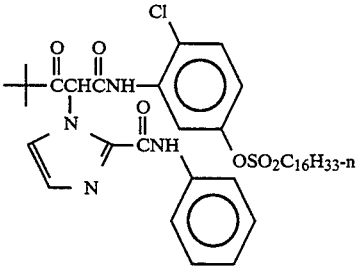
I22
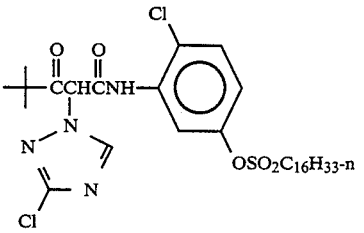

-continued

I23

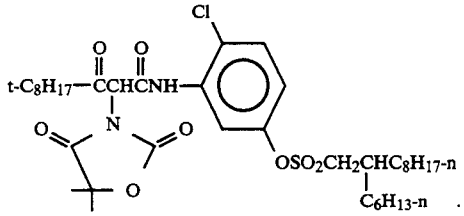

16. The photographic element of claim 1 wherein the DIR coupler contains a timing group.

17. The element of claim 16 wherein the DIR coupler has the formula:

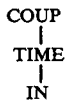

wherein:

COUP is a parent coupler moiety;

IN is an inhibitor moiety that is joined through a timing group and is released after COUP reacts with oxidized developer; and TIME is a timing group that is joined to the coupling site of COUP and allows delayed release of IN after the TIME-IN fragment is coupled off.

18. The photographic element of claim 1, wherein the DIR contains a development inhibitor selected form the group consisting of:

VII

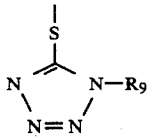

VIII

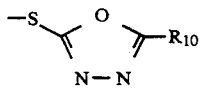

IX

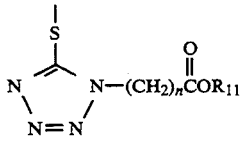

X

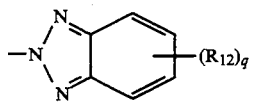

XI

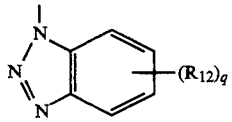

XVII

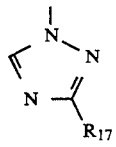

-continued

XVII

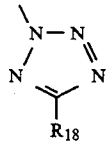

wherein:

$R_9$ is selected from the group consisting alkyl groups containing from 1 to 8 carbon atoms;

$R_{10}$ is selected from $R_9$ and —$SR_9$;

$R_{11}$ is an alkyl group containing 1 to 5 carbon atoms; n is from 1 to 3; and $R_{12}$ is selected from the group consisting of hydrogen, halogen, alkoxy, phenyl, —$COOR_{13}$ and —$NHCOOR_{13}$, wherein $R_{13}$ is an alkyl group or a phenyl group;

$R_{17}$ is an alkyl group, a phenyl group, —$COOR_{13}$, or —$NHCOR_{13}$ where $R_{13}$ is as defined for $R_{12}$; and $R_{18}$ is an alkyl group or a phenyl group.

19. The photographic element of claim 17 wherein TIME-IN has a formula selected form the group consisting of:

VII

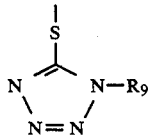

VIII

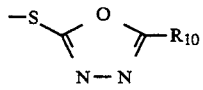

IX

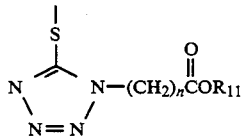

X

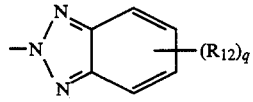

XI

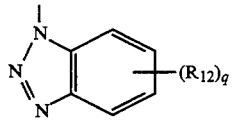

XVII

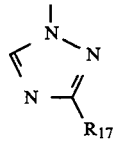

XVII

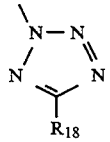

wherein:

Q and W are electron-withdrawing groups, p is 0, 1 or 2;

m is 0 or 1;

$R_{14}$ is hydrogen or an alkyl group;

$R_{15}$ is an alkyl group containing 1 to 8 carbon atoms or a phenyl group;

$R_{16}$ is an alkyl group or a phenyl group;

wherein $R_{14}$, $R_{15}$, and $R_{16}$ may be substituted as provided for $R_1$; and wherein IN is an inhibitor moiety.

20. The photographic element of claim 18 wherein the development inhibitor is has formula IX, Q is a nitro group, $R_{14}$ is hydrogen and IN has formula:

VII

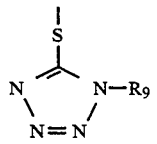

or

IX

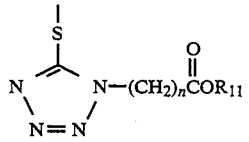

wherein:

$R_9$ is selected from the group consisting alkyl groups containing from 1 to 8 carbon atoms and phenyl;

$R_{11}$ is an alkyl group containing 1 to 5 carbon atoms; and n is from 1 to 3.

21. The photographic element of claim 19 wherein TIME-IN has formula XI, Q is a nitro group, m is 1, p is 0, and R15 is ethyl;

and wherein:

IN has the formula:

VII

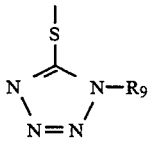

or

IX

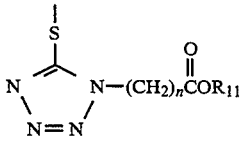

wherein:

$R_9$ is selected from the group consisting alkyl groups containing from 1 to 8 carbon atoms and phenyl;

$R_{11}$ is an alkyl group containing 1 to 5 carbon atoms; and n is from 1 to 3.

22. The photographic element of claim 1 wherein the DIR coupler is selected from the group consisting of:

D1

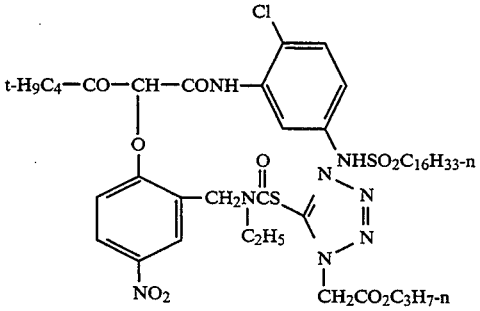

D2

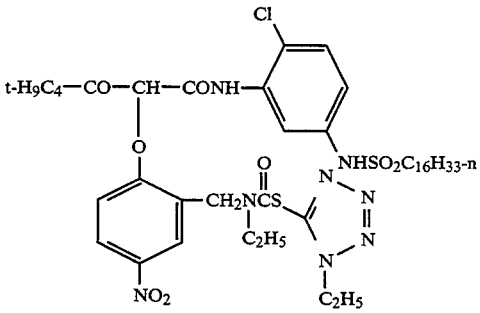

D3

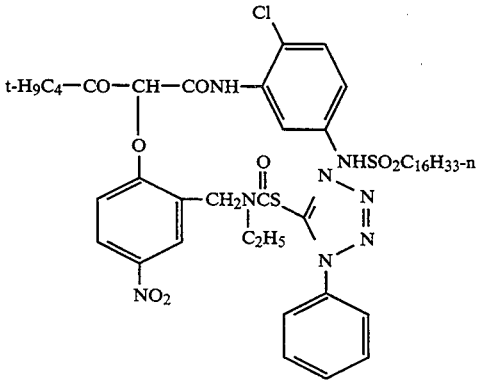

D4

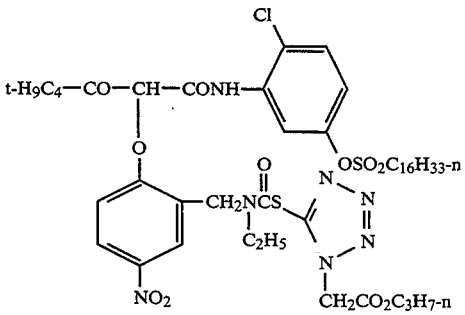

-continued
D5
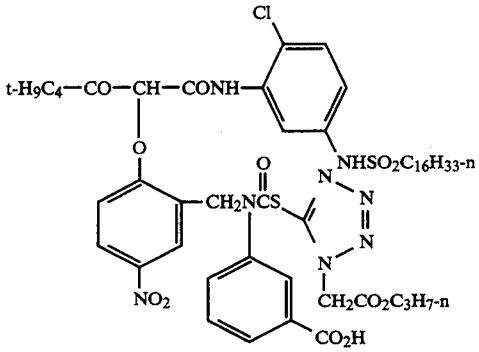
D6
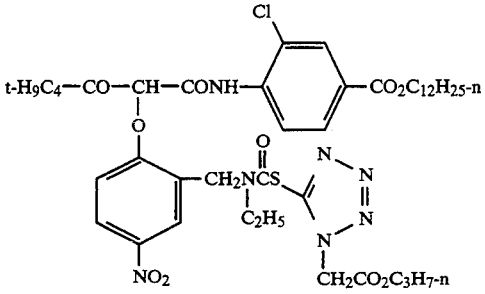
D7
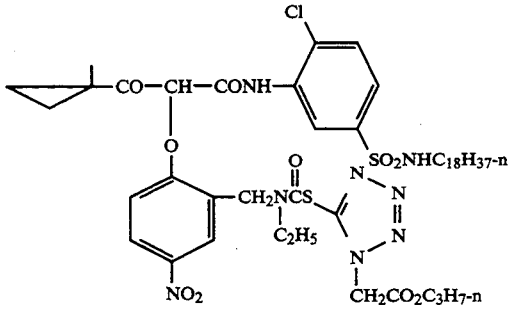
D8
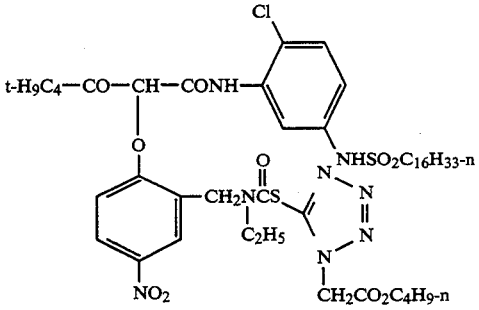
D9
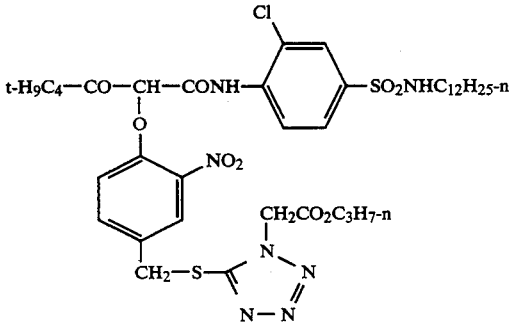
D10
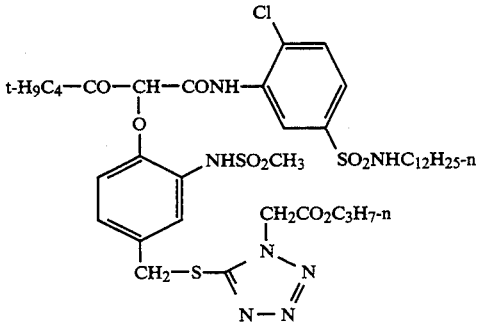
D11
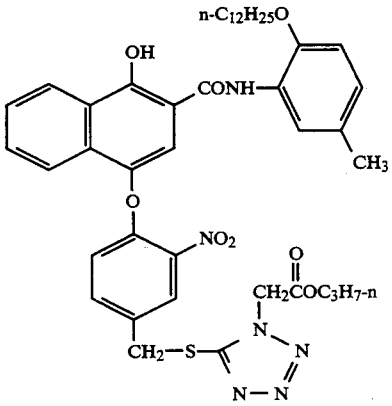
D12
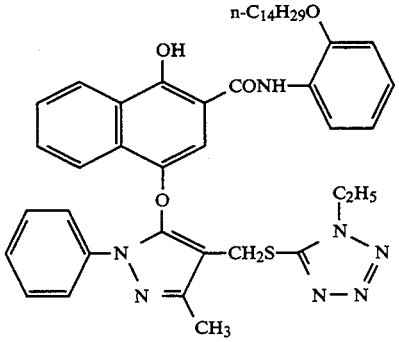

-continued
D13
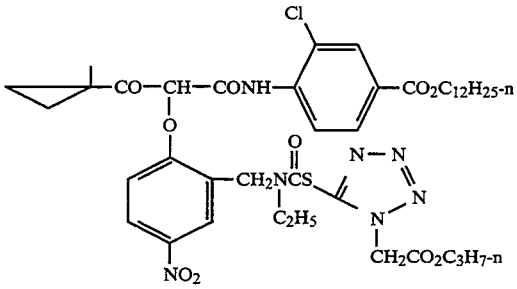
D14
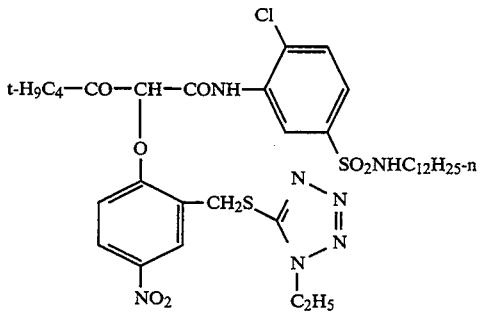
D15
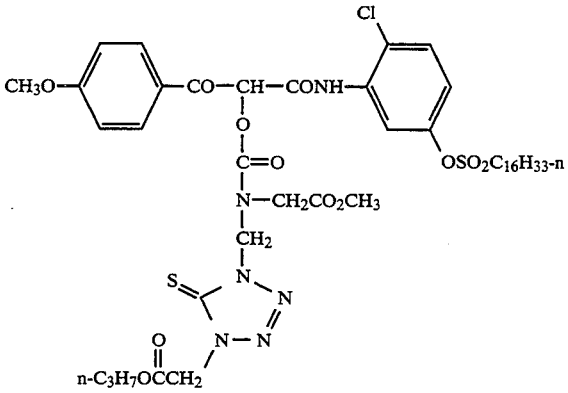
D16
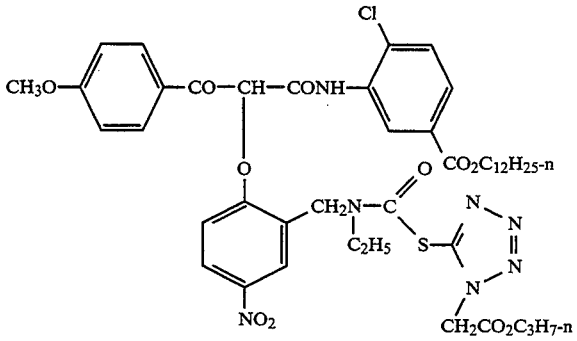
D17
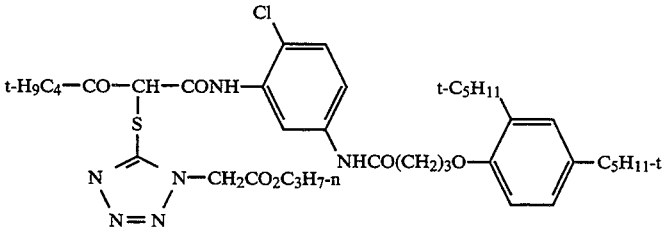
D18
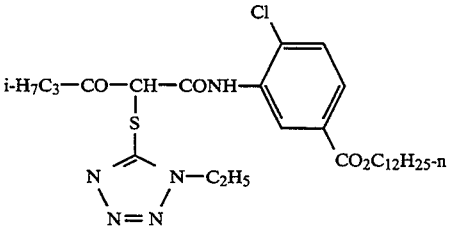
D19
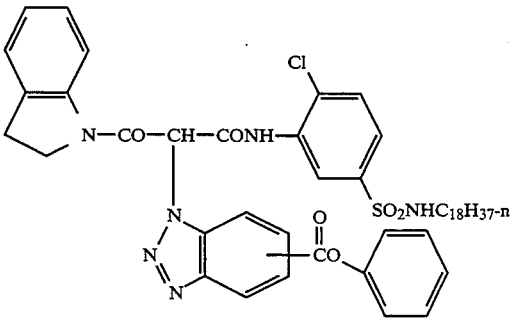

-continued

D20

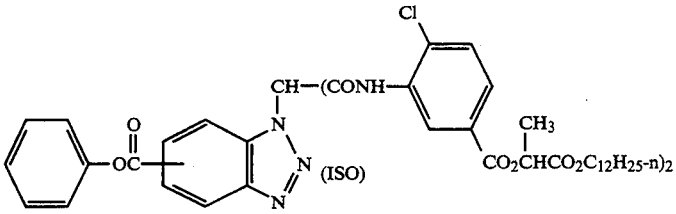

D21

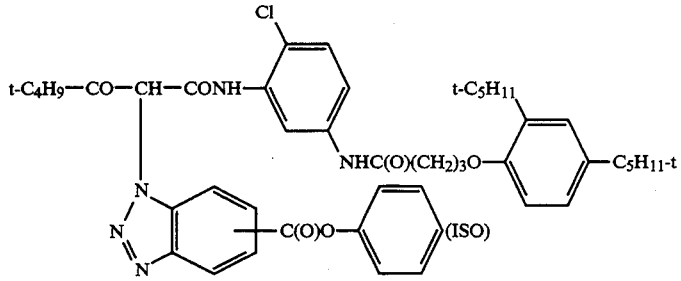

D22

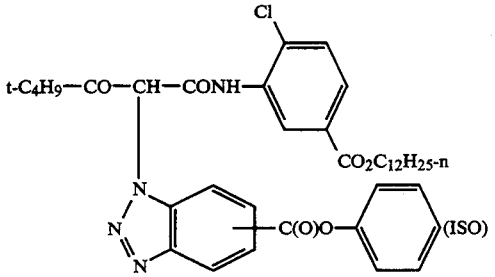

D23

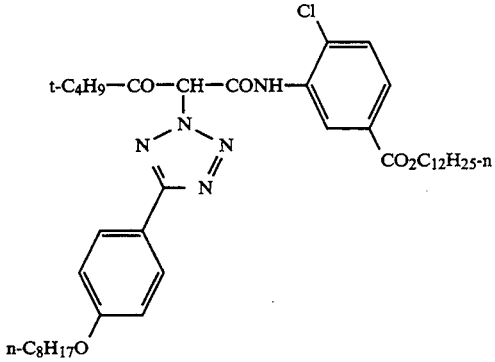

D24

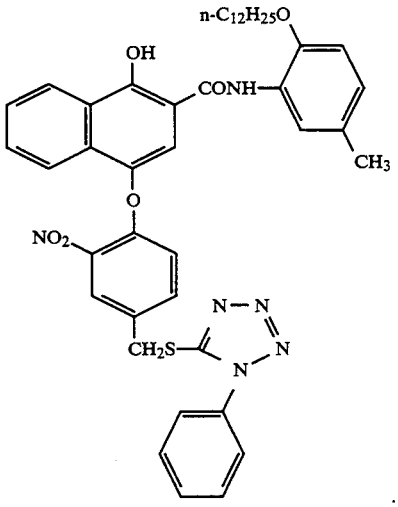

23. The photographic element of claim 22 wherein the DIR coupler has a formula selected from the group consisting of D1, D4, D6, D7, D8, D21, and D22.

24. The photographic element of claim 1 wherein the coated level of the DIR coupler is 0.01 to 1.00 g/sq.m.

25. The photographic element of claim 1, additionally containing a benzoylacetanilide yellow dye-forming imaging coupler associated with the blue-light sensitive silver halide emulsion layer.

26. A method of forming an image in a photographic element as described in claim 1 which comprises exposing said element to light and thereafter developing the element with a color developer.

* * * * *